US011859471B2

(12) United States Patent
Sokolove et al.

(10) Patent No.: US 11,859,471 B2
(45) Date of Patent: Jan. 2, 2024

(54) MODULAR INITIATOR

(71) Applicant: Hunting Titan, Inc., Pampa, TX (US)

(72) Inventors: Christopher Sokolove, Midlothian, TX (US); Chenghua Han, Sugar Land, TX (US); Faraidoon Pundole, Sugar Land, TX (US); Jason Hoang Mai, Houston, TX (US)

(73) Assignee: Hunting Titan, Inc., Pampa, TX (US)

( * ) Notice: Subject to any disclaimer, the term of this patent is extended or adjusted under 35 U.S.C. 154(b) by 0 days.

(21) Appl. No.: 18/336,762

(22) Filed: Jun. 16, 2023

(65) Prior Publication Data

US 2023/0332489 A1 Oct. 19, 2023

Related U.S. Application Data

(60) Continuation of application No. 17/814,521, filed on Jul. 24, 2022, which is a division of application No. 16/636,571, filed as application No. PCT/US2018/045635 on Aug. 7, 2018, now Pat. No. 11,492,878.

(60) Provisional application No. 62/630,048, filed on Feb. 13, 2018, provisional application No. 62/542,152, filed on Aug. 7, 2017.

(51) Int. Cl.

| | |
|---|---|
| ***F42B 3/182*** | (2006.01) |
| ***E21B 43/1185*** | (2006.01) |
| ***F42B 3/12*** | (2006.01) |

(52) U.S. Cl.

CPC ..... *E21B 43/1185* (2013.01); *F42B 3/121* (2013.01); *F42B 3/182* (2013.01)

(58) Field of Classification Search

CPC ..... F42B 3/18; F42B 3/182; F42B 3/185
USPC ..... 102/202.4, 202.3, 202.1
See application file for complete search history.

(56) References Cited

U.S. PATENT DOCUMENTS 8,661,978 B2 * 3/2014 Backhus ..... F42B 3/122 102/202.3

* cited by examiner

*Primary Examiner* — Reginald S Tillman, Jr.

(57) ABSTRACT

A modular initiator assembly comprising a receptacle and connector combination adapted to shunt the electrical contacts of the initiator as a default condition and to only unshunt the electrical contacts coupled to the initiator when the receptacle and connector establish a fully seated connection.

20 Claims, 21 Drawing Sheets

MODULAR INITIATOR

RELATED APPLICATIONS

This application is a continuation of U.S. patent application Ser. No. 17/814,521, filed Jul. 24, 2022, which is a divisional of U.S. patent application Ser. No. 16/636,571, issued as U.S. Pat. No. 11,492,878, filed on Feb. 4, 2020, which is a 371 national stage application of PCT/US18/45635, filed on Aug. 7, 2018, which claims the benefit of U.S. Provisional Application No. 62/542,152, filed Aug. 7, 2017 and U.S. Provisional Application No. 62/630,048, filed Feb. 13, 2018.

BACKGROUND OF THE INVENTION

Generally, when completing a subterranean well for the production of fluids, minerals, or gases from underground reservoirs, several types of tubulars are placed downhole as part of the drilling, exploration, and completions process. These tubulars can include casing, tubing, pipes, liners, and devices conveyed downhole by tubulars of various types. Each well is unique, so combinations of different tubulars may be lowered into a well for a multitude of purposes.

A subsurface or subterranean well transits one or more formations. The formation is a body of rock or strata that contains one or more compositions. The formation is treated as a continuous body. Within the formation hydrocarbon deposits may exist. Typically a wellbore will be drilled from a surface location, placing a hole into a formation of interest. Completion equipment will be put into place, including casing, tubing, and other downhole equipment as needed. Perforating the casing and the formation with a perforating gun is a well known method in the art for accessing hydrocarbon deposits within a formation from a wellbore.

Explosively perforating the formation using a shaped charge is a widely known method for completing an oil well. A shaped charge is a term of art for a device that when detonated generates a focused output, high energy output, and/or high velocity jet. This is achieved in part by the geometry of the explosive in conjunction with an adjacent liner. Generally, a shaped charge includes a metal case that contains an explosive material with a concave shape, which has a thin metal liner on the inner surface. Many materials are used for the liner; some of the more common metals include brass, copper, tungsten, and lead. When the explosive detonates, the liner metal is compressed into a superheated, super pressurized jet that can penetrate metal, concrete, and rock. Perforating charges are typically used in groups. These groups of perforating charges are typically held together in an assembly called a perforating gun. Perforating guns come in many styles, such as strip guns, capsule guns, port plug guns, and expendable hollow carrier guns.

Perforating charges are typically detonated by detonating cord in proximity to a priming hole at the apex of each charge case. Typically, the detonating cord terminates proximate to the ends of the perforating gun. In this arrangement, an initiator at one end of the perforating gun can detonate all of the perforating charges in the gun and continue a ballistic transfer to the opposite end of the gun. In this fashion, numerous perforating guns can be connected end to end with a single initiator detonating all of them.

The detonating cord is typically detonated by an initiator triggered by a firing head. The firing head can be actuated in many ways, including but not limited to electronically, hydraulically, and mechanically.

Expendable hollow carrier perforating guns are typically manufactured from standard sizes of steel pipe with a box end having internal/female threads at each end. Pin ended adapters, or subs, having male/external threads are threaded one or both ends of the gun. These subs can connect perforating guns together, connect perforating guns to other tools such as setting tools and collar locators, and connect firing heads to perforating guns. Subs often house electronic, mechanical, or ballistic components used to activate or otherwise control perforating guns and other components.

Perforating guns typically have a cylindrical gun body and a charge tube, or loading tube that holds the perforating charges. The gun body typically is composed of metal and is cylindrical in shape. Charge tubes can be formed as tubes, strips, or chains. The charge tubes will contain cutouts called charge holes to house the shaped charges.

It is generally preferable to reduce the total length of any tools to be introduced into a wellbore. Among other potential benefits, reduced tool length reduces the length of the lubricator necessary to introduce the tools into a wellbore under pressure. Additionally, reduced tool length is also desirable to accommodate turns in a highly deviated or horizontal well. It is also generally preferable to reduce the tool assembly that must be performed at the well site because the well site is often a harsh environment with numerous distractions and demands on the workers on site.

Currently, perforating guns are often assembled and loaded at a service company shop, transported to the well site, and then armed before they are deployed into a well. Sometimes perforating guns are assembled and armed at the well site. Because the service company shop often employs a single gun loader, maintaining close control on the gun assembly/loading procedures can become difficult. Accordingly, quality control on the assembled/loaded guns may be improved by reducing the amount of assembly necessary at the service company shop.

Electric initiators are commonly used in the oil and gas industry for initiating different energetic devices down hole. Most commonly, 50-ohm resistor initiators are used. Other initiators and electronic switch configurations, such as the Hunting ControlFire technology and DynaSelect technology, are also common.

Following industry safe practices, an electric initiator must always remain shunted, except for during specific uses. This shunt is an electrical short which prevents electrical energy from initiating the device unexpectedly, such as due to radio frequency energy or stray voltage. Other designs, such as short, looped, or no leg wires may mitigate the risk of radio frequency issues.

If the shunt is to be removed, either for arming purposes or for connecting it to an electronic switch, then the initiator must be placed in a safety housing while the shunt is removed. Generally, this requires electric initiators to have lead wires which are exposed outside of the safety housing so as to allow someone to remove the shunt and connect the initiator safely.

The process of removing the initiator shunt is commonly done in the field because most US and all international regulations prohibit the transportation of initiators inside of a perforating gun or other device. Therefore, in the event of a misrun, the initiator must be removed from the perforating gun or other device and the shunt must be re-installed before transporting.

Removal of the shunt, making wiring connections, or replacing the shunt are all inefficient processes. They require leads on the initiator which increases the working footprint and requires the use of additional safety devices such as an initiator safety housing which is bulky. Problems in wiring can lead to misruns. Having to reapply the shunt is tedious and requires proper training to ensure it is done correctly before offering the devices for transport.

Various companies have attempted to remedy these issues. Examples include pairing the initiator directly to an electronic switch in a single package. This solution is non-ideal because it increases the size and fixes the geometry of the initiator, putting additional constraints on its storage and application. The initiator must be used in a specific configuration and hardware. This solution does not prove versatility. Hunting resolves the issues by assembling the initiator to an electronic switch in a controlled manufacturing environment and offers the product as the ControlFire Assembly. This solution increases the size and has exposed wires connecting different components. It provides much more flexibility in which devices it can be used. However, there is a mechanical shunt that must be removed and is sometimes forgotten, resulting in a misrun. This assembly, as well as variations such as the ControlFire Cartridge, utilizes large packaging which takes up significant magazine storage space at a cost to the customer.

Setting a bridge plug typically requires setting a "slip" mechanism that engages and locks the bridge plug with the casing and energizing the packing element in the case of a bridge plug. This requires large forces, often in excess of 20,000 lbs. The activation or manipulation of some setting tools involves the activation of an energetic material such as an explosive pyrotechnic or black powder charge to provide the energy needed to deform a bridge plug. The energetic material may use a relatively slow burning chemical reaction to generate high pressure gases. One such setting tool is the Model E-4 Wireline Pressure Setting Tool of Baker International Corporation, sometimes referred to as the Baker Setting Tool.

The pressure from the power charge igniting is contained with the power charge chamber by the sealed firing head. The pressure builds in the chamber and causes a floating first piston to move down through the tool, compressing the oil reservoir through a small hole in a connector sub.

A jet cutter is an explosive shaped charge that has a circumferential V-type shape. The explosive is combined with a liner. The components are all contained in a housing. The jet cutter is lowered to the desired point in a well where the separation of existing tubulars is desired. Firing a jet cutter generates a high energy plasma jet, typically in 360 degrees of direction, that will severe any adjacent tubulars.

SUMMARY OF EXAMPLE EMBODIMENTS

An example embodiment may include a modular initiator assembly having a receptacle having a boxlike portion adapted to couple a plurality of conductors and an extending connection portion having a pair of pincer electrical contacts, and a wedge shaped protrusion located in between the pair of electrical contacts, a connector adapted to accept the connection portion of the receptacle and have a pair of electrically conductive blades therethrough, each blade having a side springing extension that contacts each other, wherein the installation of the receptacle into the connector causes the pincer electrical contacts to first electrically couple the plurality of conductors to the corresponding blades, which are shunted due to the springing extensions, and then second, when fully inserted, the wedge shaped protrusion separates the springing extension to electrically unshunt the initiator.

A variation of the example embodiments may include having a shell coupled to the connector and having an initiator located within the shell, wherein the initiator is activated via an electrical signal from the plurality of conductors coupled to the receptacle. The shell may contain a resistor based bridgewire initiator. The shell may contain an exploding bridge wire initiator. The shell may contain an exploding foil initiator. The shell may contain a high explosive. It may include a plurality of resistors within the shell. It may include a circuit board, in which the receptacle is hard mounted to the circuit board. The receptacle may be connected to the circuit board with a plurality of conductors. The modular initiator assembly may be used to initiate a perforating gun. The modular initiator assembly may be used to initiate a cutter. The modular initiator assembly may be used to initiate a setting tool.

An example embodiment may include a gun string assembly having a first perforating gun suspending from a wireline, a switch tandem having an inner bore, coupled to and located downhole from the first perforating gun, a second perforating gun coupled to and located downhole from the switch tandem, a modular initiator assembly disposed in the inner bore of the switch tandem further having a receptacle having a boxlike portion adapted to couple a plurality of conductors and an extending connection portion having a pair of pincer electrical contacts, and a wedge shaped protrusion located in between the pair of electrical contacts, a connector adapted to accept the connection portion of the receptacle and have a pair of electrically conductive blades therethrough, each blade having a side springing extension that contacts each other, wherein the installation of the receptacle into the connector causes the pincer electrical contacts to first electrically couple the plurality of conductors to the corresponding blades, which are shunted due to the springing extensions, and then second, when fully inserted, the wedge shaped protrusion separates the springing extension to electrically unshunt the plurality of conductors.

An example embodiment may include a method for connecting an initiator to an electrical source by connecting a receptacle to a circuit board and then installing the initiator into the receptacle wherein the process of installation first electrically connects the initiator to the circuit board and then disengages the shunt in the initiator.

An example embodiment may include a method for detonating a perforating gun string including assembling a perforating gun string, coupling a first initiator to a modular the initiator assembly further comprising connecting a plurality of conductors from a circuit board to a receptacle, shunting the plurality of conductors by first plugging it in partially into a connector, unshunting the plurality of conductors by fully inserting it into a connector, wherein the plurality of conductors is electrically engaged to a initiator only when fully inserted into the connector, lowering a perforating gun string downhole to a predetermined location, firing the modular initiator assembly, wherein the modular initiator assembly is coupled to a detonating cord, and detonating a perforating gun coupled to the detonating cord.

An example embodiment may include a method for assembling a perforating gun string comprising coupling a first initiator to a receptacle to form a modular initiator assembly, wherein the receptacle is attached to the circuit board and the first initiator is self-shunted, plugging the initiator into the receptacle, and maintaining the shunt during the installation of the initiator to the receptacle, wherein no safety housing is necessary.

An example embodiment may include a method for assembling a perforating gun string comprising coupling the receptacle with a plurality of conductors to a safe circuit, coupling a first initiator to the receptacle to form a modular initiator assembly, wherein the receptacle is attached to the circuit board and the first initiator is self-shunted, plugging the initiator into the receptacle, and maintaining the shunt during the installation of the initiator to the receptacle, wherein no safety housing is necessary.

The maintaining of the shunt may protect the initiator from stray voltage. The maintaining of the shunt may protect the initiator from stray electrical energy. The maintaining of the shunt may protect the initiator from stray radio frequency signals. It may include installing the modular initiator assembly into a perforating gun string. It may include lowering a perforating gun string downhole to a predetermined location. It may include firing the modular initiator assembly, wherein the modular initiator assembly is coupled to a detonating cord. It may include firing the modular initiator assembly, wherein the modular initiator assembly is coupled to a booster. It may include detonating a perforating gun coupled to the detonating cord.

An example embodiment may include a method for connecting an initiator having a connector to an electrical source comprising connecting a plurality of conductors from a circuit board to a receptacle, electrically coupling the receptacle to a connector, maintaining the shunt by first plugging the receptacle partially into the connector, shunting the plurality of conductors when the receptacle is partially plugged into the connector, and unshunting the plurality of conductors by fully inserting the connector and the receptacle, wherein the plurality of conductors is electrically coupled to an initiator. A variation of the example embodiment may include removing the initiator from the receptacle, wherein the removal of the initiator from the receptacle automatically shunts the initiator.

BRIEF DESCRIPTION OF THE DRAWINGS

For a thorough understanding of the present invention, reference is made to the following detailed description of the preferred embodiments, taken in conjunction with the accompanying drawings in which reference numbers designate like or similar elements throughout the several figures of the drawing. Briefly.

DETAILED DESCRIPTION OF EXAMPLES OF THE INVENTION

In the following description, certain terms have been used for brevity, clarity, and examples. No unnecessary limitations are to be implied therefrom and such terms are used for descriptive purposes only and are intended to be broadly construed. The different apparatus, systems and method steps described herein may be used alone or in combination with other apparatus, systems and method steps. It is to be expected that various equivalents, alternatives, and modifications are possible within the scope of the appended claims. Terms such as initiator are not to be construed as limiting. For instance, an initiator, which for example provides a high energy output for initiating a detonating cord, booster or other high explosive, in this description may also include an igniter or electric match, which provides flame and heat adapted for igniting a power charge, propellant, or similar pyrotechnic. Furthermore, initiator may include a stand alone heating element intended to initiate a high explosive or pyrotechnic device.

Figure 1B:
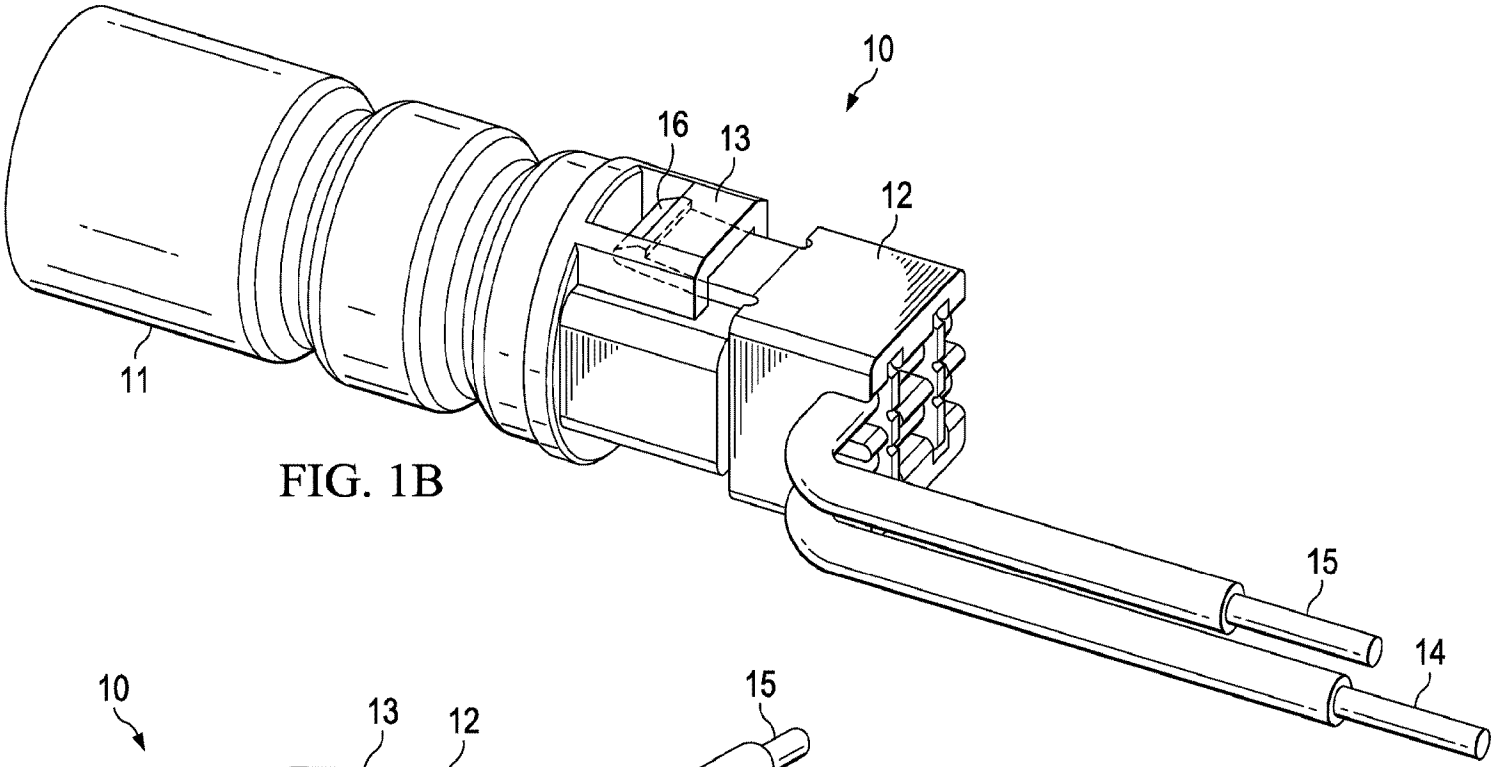
FIG. 1B shows a modular initiator assembly.
Figure 1A:
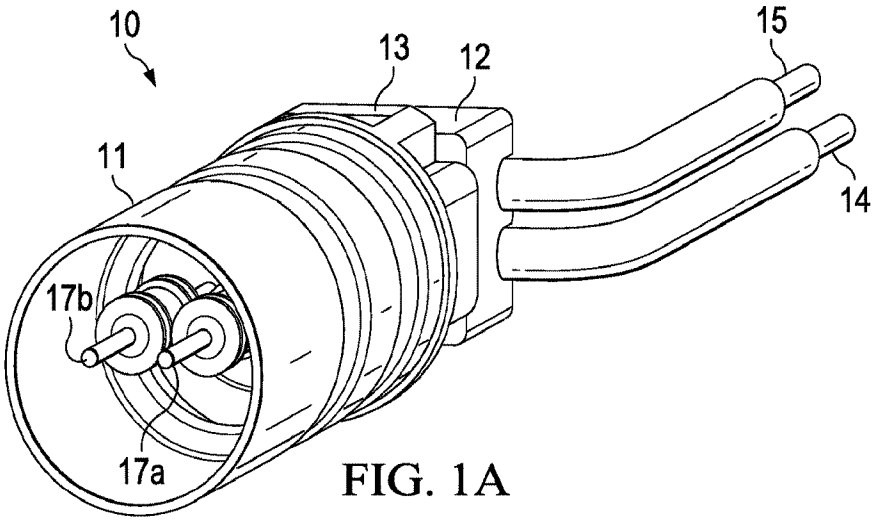
FIG. 1A shows a modular initiator assembly.

A modular initiator is depicted in FIG. 1A and FIG. 1B. The modular initiator serves the purpose of providing a high energy output to initiate a second explosive device such as a detonating cord, a booster, a power charge, or propellant. The modular initiator requires electrical input to transfer electrical energy into a high energy output. The modular initiator contains a rigid connector for the purpose of assembling the initiator to a receiving circuit or installing in a contact block such that it may function as a standalone unit. The modular initiator may be used in a variety of explosive systems requiring electrical initiation.

A contact block provides electrical feed through to allow the modular initiator to function without the need for additional electrical connections. The electrical circuit may be a printed circuit board, flexible circuit board, or other commonly used electrical boards or combinations. There may be many features included in the circuitry including switches, safety features, RF isolation, two-way communication with the surface, temperature measurement circuitry, pressure measurement circuitry, and other features not directly required for initiating the modular initiator. Electrical energy will pass through the electrical circuit to initiate the modular initiator through a rigid connector.

Figure 1C:
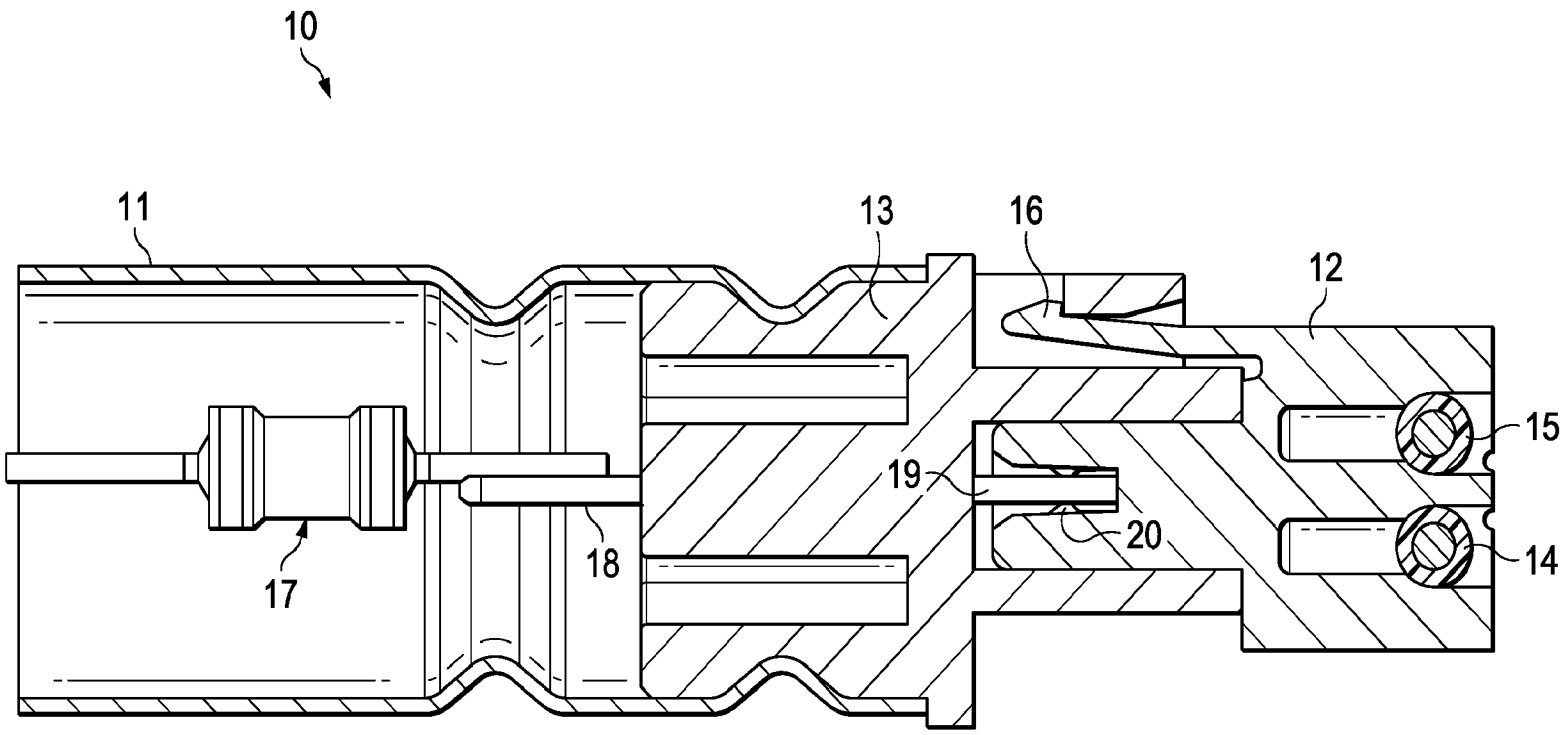
FIG. 1C shows a cross section of a modular initiator assembly.

Referring to FIGS. 1A, 1B, and 1C, a modular initiator assembly 10 has a receptacle 12 having a latch 16 and contacts 20 are coupled to the connector 13. Connector 13 includes contact blades 19 that engage with the contacts 20. The contact blades 19 are further coupled to the resistors 17*a* and 17*b* via resister leads 18. Resister leads 18, which may be continuous portions of contact blades 19, are coupled to corresponding resistors 17. A shell 11 is crimped onto the connector 13. Wire 14 and 15 are coupled to the receptacle 12. The design is such that each wire 14 or 15 has a corresponding contact 20, a corresponding contact blade 19, a corresponding resistor lead 18, and a corresponding resistor 17*a* or 17*b*. Latch 16 locks the receptacle 12 into the connector 13.

Figure 2A:
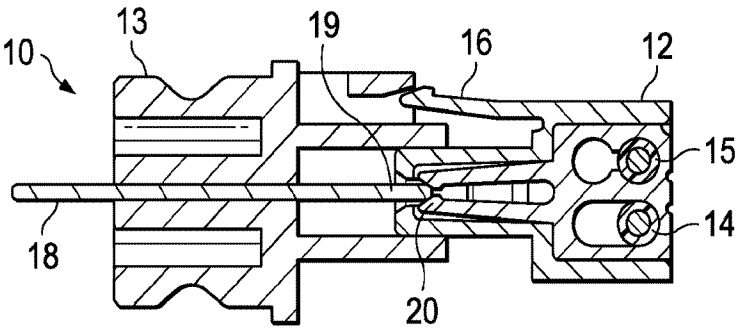
FIG. 2A shows a side cross section of a modular initiator assembly.
Figure 2B:
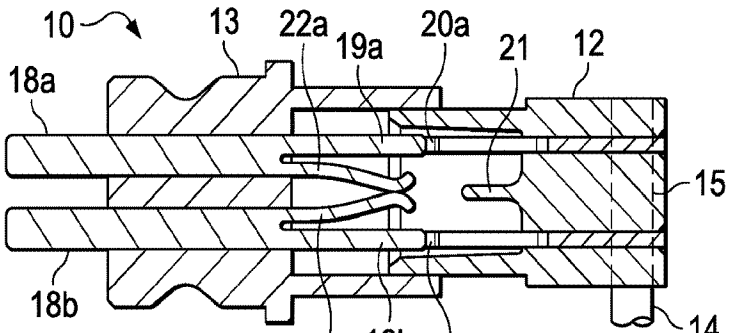
FIG. 2B shows a top cross section of a modular initiator assembly.

Referring to FIGS. 2A, 2B, 2C, 2D, 2E, and 2F, a side cross section and corresponding side cross section of the modular initiator assembly 10 are shown in different stages of engagement. Stage 1 is depicted by FIGS. 2A and 2B. In stage 1 the receptacle 12 is partially inserted into the connector 13, approximately one-third or less of the way inserted, there is no electrical connection between the receptacle 12 and connector 13 and the shunt, represented by shunt contacts 22*a* and 22*b*, are in the shunted position. In this configuration the modular initiator assembly 10 is self-protected from radio frequency signals and stray voltages. As can be seen in FIG. 2B, the shunt contacts 22*a* and 22*b* are electrically in contact with each other, forming an electrical shunt between contact blades 19*a* and 19*b*. The latch 16 is not engaged. The signal contacts 20*a* and 20*b* are not engaged with the corresponding blades 19*a* and 19*b*. The separator 21, a non-conductive wedge shaped part of the receptacle 12, is not engaged with the shunt contacts 22*a* and 22*b*. Contact blades 19*a* and 19*b* have corresponding resistor contacts 18*a* and 18*b*. The wires 14 and 15 can be arranged side by side, or opposite of each other, depending on the application.

Figure 2C:
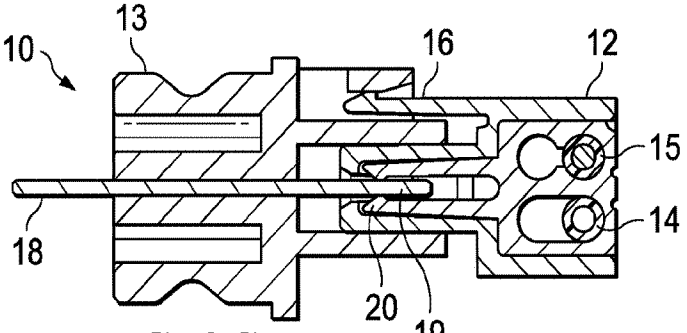
FIG. 2C shows a side cross section of a modular initiator assembly.
Figure 2D:
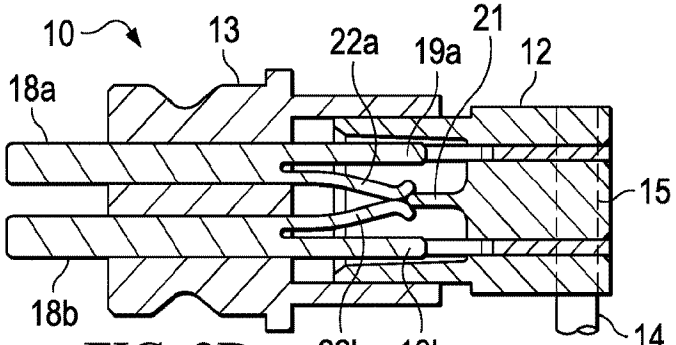
FIG. 2D shows a top cross section of a modular initiator assembly.

Stage 2 is depicted in FIGS. 2C and 2D when the receptacle 12 is approximately between one third and two thirds of the way inserted into the connector 13. Here electrical connections have been established between the receptacle 12 and the connector 13 while the shunt remains in place due to shunt contacts 22*a* and 22*b* still being in contact. In this state the modular initiator assembly 10 is electrically protected by the initiator shunt and the circuit connected to the receptacle and is in a transition state. As can be seen in FIG. 2D, the shunt contacts 22*a* and 22*b* are electrically in contact with each other, forming an electrical shunt between contact blades 19*a* and 19*b*. The latch 16 is deflected, but not engaged. The signal contacts 20*a* and 20*b* are engaged with the corresponding blades 19*a* and 19*b*. The separator 21, is beginning to make contact with the shunt contacts 22*a* and 22*b*, but it has not yet separated them.

Figure 2E:
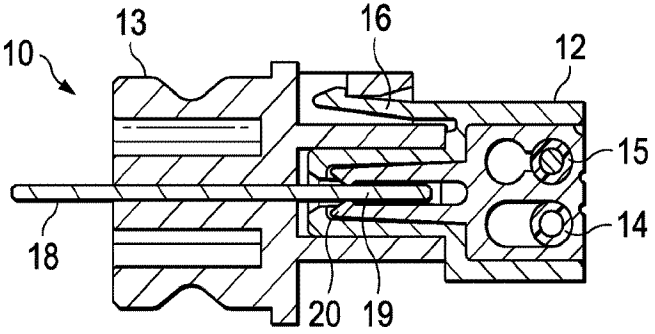
FIG. 2E shows a side cross section of a modular initiator assembly.
Figure 2F:
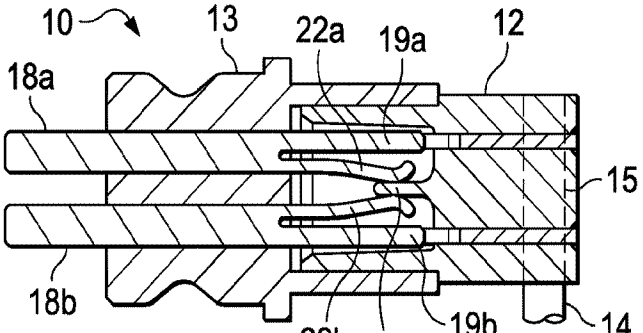
FIG. 2F shows a top cross section of a modular initiator assembly.

Stage 3 is depicted in FIGS. 2E and 2F when the receptacle 12 is more than two thirds of the way inserted into connector 13. The receptacle 12 is in electrical communication with the connector 13 and is no longer shunted. As can be seen in FIG. 2F, the shunt contacts 22*a* and 22*b* are not electrically in contact with each other due to separator 21 wedging them apart, therefore contact blades 19*a* and 19*b* are unshunted. The latch 16 is engaged into the connector 13. The signal contacts 20*a* and 20*b* are engaged with the corresponding blades 19*a* and 19*b*.

Figure 3A:
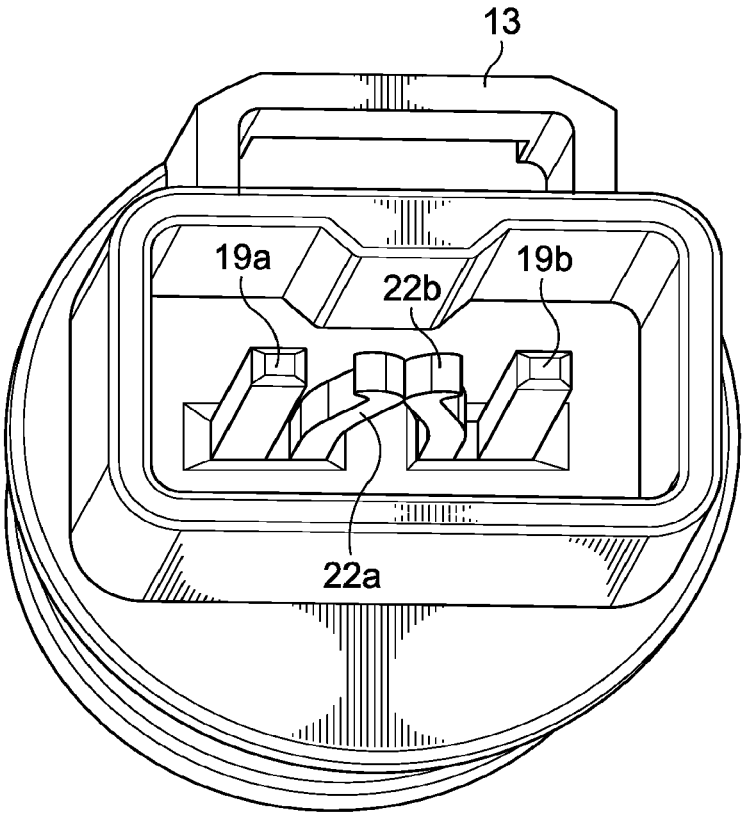
FIG. 3A shows a connector for a modular initiator assembly.
Figure 3B:
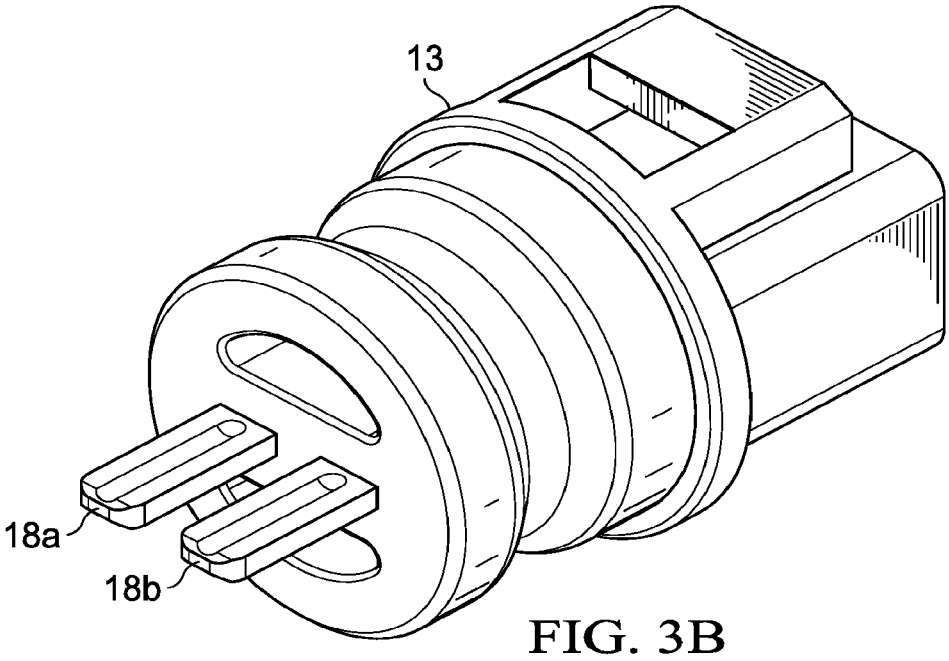
FIG. 3B shows a connector for a modular initiator assembly.

FIGS. 3A and 3B show additional detail of the connector 13. The contact blades 19*a* and 19*b* and their corresponding shunt contacts 22*a* and 22*b* are shown. Furthermore, contact blades 19*a* and 19*b* have corresponding resistor contacts 18*a* and 18*b*.

Figure 4A:
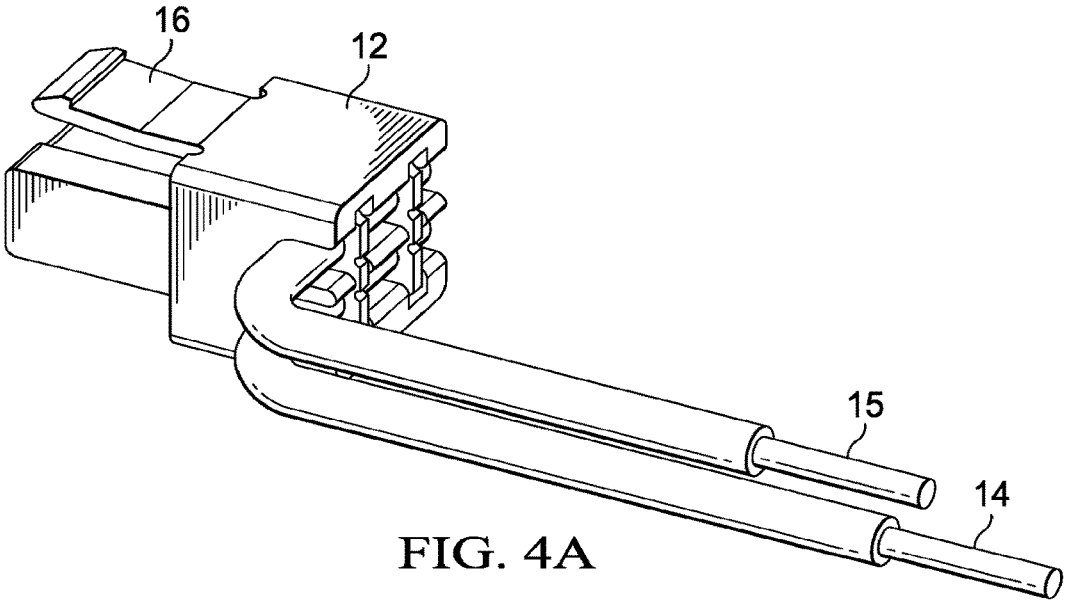
FIG. 4A shows a receptacle for a modular initiator assembly.
Figure 4B:
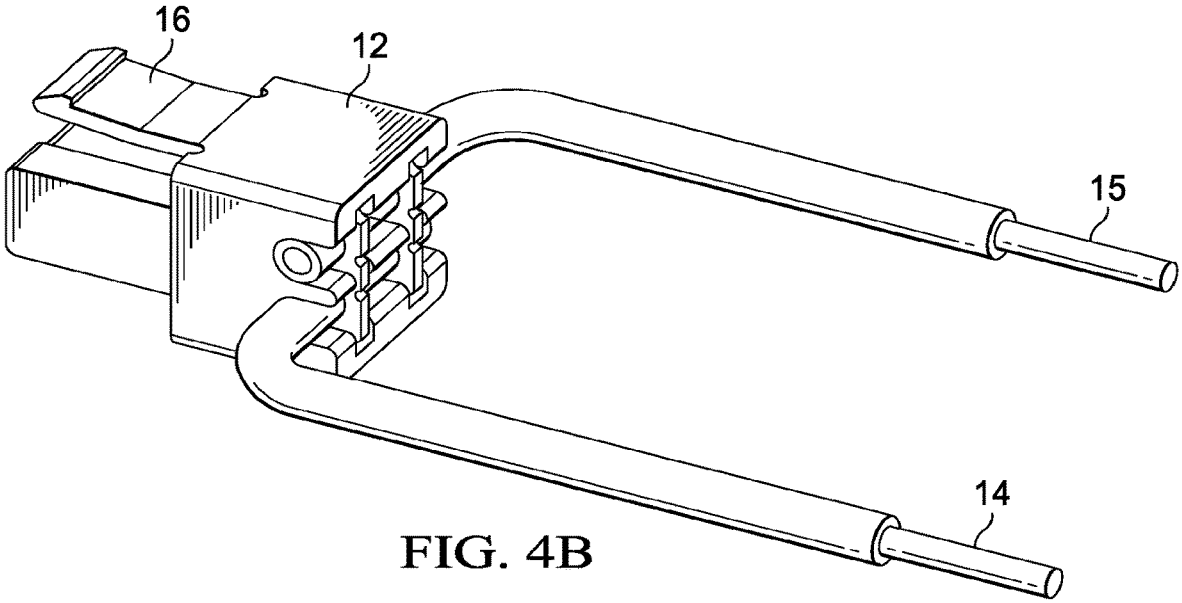
FIG. 4B shows a receptacle for a modular initiator assembly.

FIGS. 4A and 4B show additional detail of the receptacle 12. The latch 16 is integrally formed to the receptacle. The wires 14 and 15 can be arranged side by side, or opposite of each other, depending on the application. In FIG. 4A one wire is strain-relieved while the other is not. In FIG. 4B both wires are strain relieved.

Figure 5A:
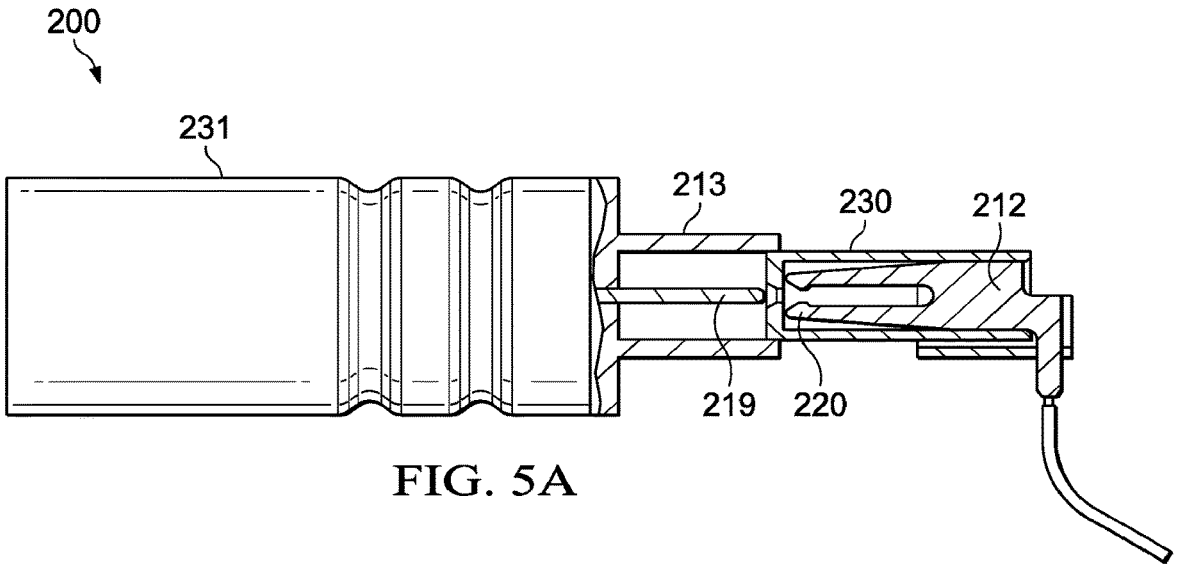
FIG. 5A shows a side cross section of a modular initiator assembly.
Figure 5B:
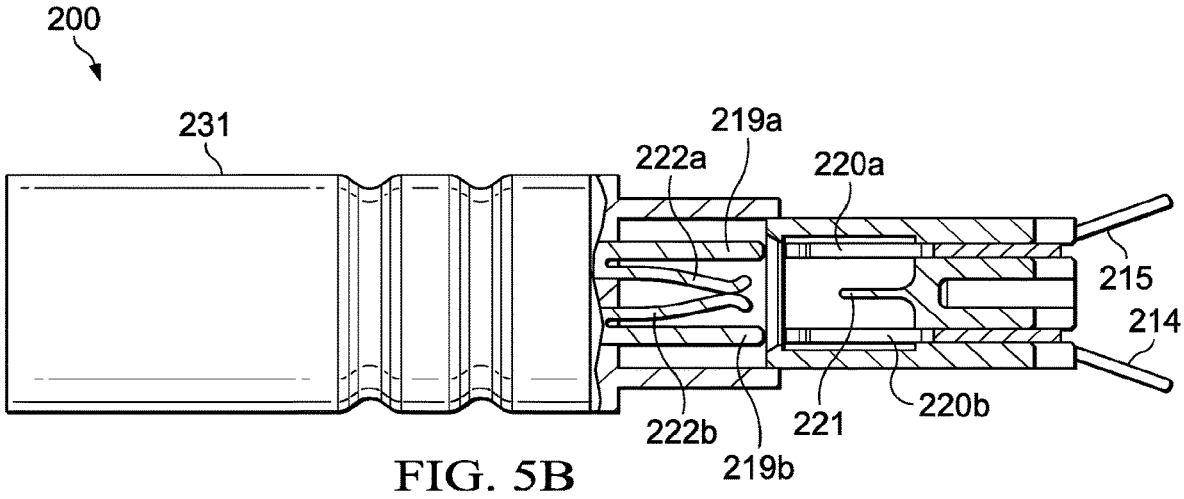
FIG. 5B shows a top cross section of a modular initiator assembly.

Referring to FIGS. 5A, 5B, 5C, 5D, 5E, and 5F a side cross section and corresponding side cross section of the modular connector assembly 200 are shown in different stages of engagement. A modular initiator assembly 200 has a receptacle 212 having contacts 220 are coupled to the connector 213. Connector 213 includes contact blades 219 that engage with the contacts 220. The contact blades 219 are further coupled to the resistors 217*a* and 217*b* via resister leads 218. Stage 1 is depicted by FIGS. 5A and 5B. In stage 1 the receptacle 212 is partially inserted into the connector 213, approximately one-third or less of the way inserted, there is no electrical connection between the receptacle 212 and connector 213 and the shunt, represented by shunt contacts 222*a* and 222*b*, are in the shunted position. In this configuration the modular initiator assembly 210 is self-protected from radio frequency signals and stray voltages. As can be seen in FIG. 5B, the shunt contacts 222*a* and 222*b* are electrically in contact with each other, forming an electrical shunt between contact blades 219*a* and 219*b*. A latch may be used in this configuration to ensure a positive and locking engagement, but it is not shown. The signal contacts 220*a* and 220*b* are not engaged with the corresponding blades 219*a* and 219*b*. Therefore, the wires 214 and 215 are not connected. The separator 221, a non-conductive part of the receptacle 212, is not engaged with the shunt contacts 222*a* and 222*b*. Housing 231 is coupled to connector 213.

Figure 5C:
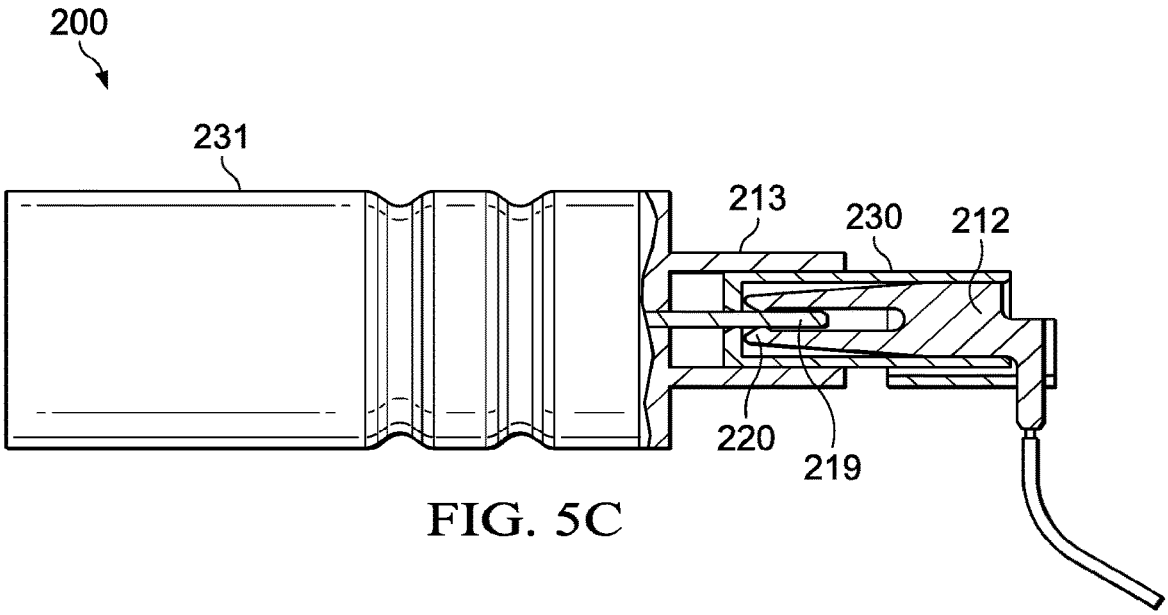
FIG. 5C shows a side cross section of a modular initiator assembly.
Figure 5D:
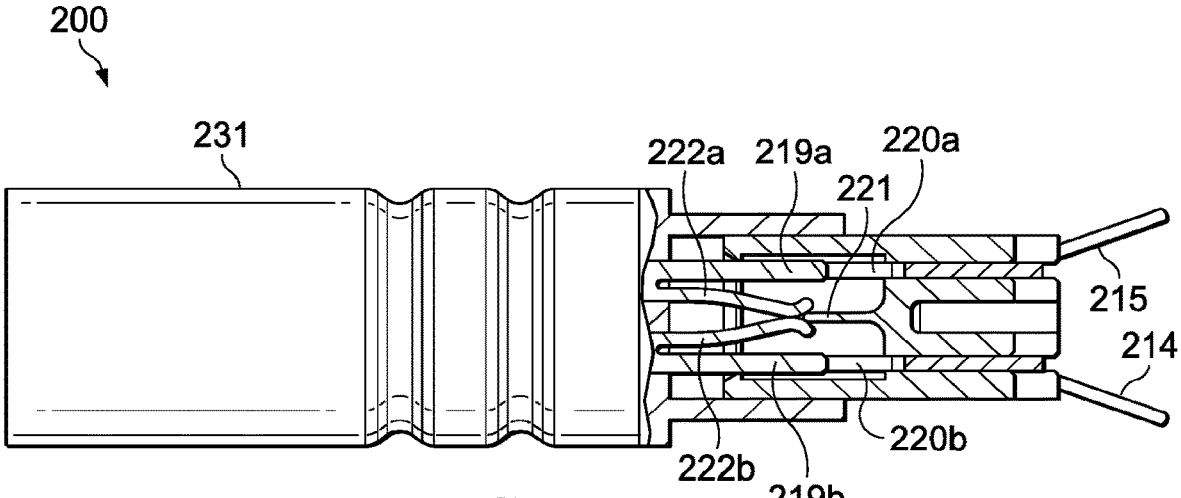
FIG. 5D shows a top cross section of a modular initiator assembly.

Stage 2 is depicted in FIGS. 5C and 5D when the receptacle 212 is approximately between one third and two thirds of the way inserted into the connector 213. Here electrical connections have been established between the receptacle 212 and the connector 213 while the shunt remains in place due to shunt contacts 222*a* and 222*b* still being in contact. In this state the modular initiator assembly 210 is electrically protected by the initiator shunt and the circuit connected to the receptacle and is in a transition state. As can be seen in FIG. 5D, the shunt contacts 222*a* and 222*b* are electrically in contact with each other, forming an electrical shunt between contact blades 219*a* and 219*b*. The signal contacts 220*a* and 220*b* are engaged with the corresponding blades 219*a* and 219*b*, however, because of the shunting, the signal contacts 220*a* and 220*b*, and their corresponding wires 214 and 215, are connected. The separator 221, is beginning to make contact with the shunt contacts 222*a* and 222*b*, but it has not yet separated them.

Figure 5E:
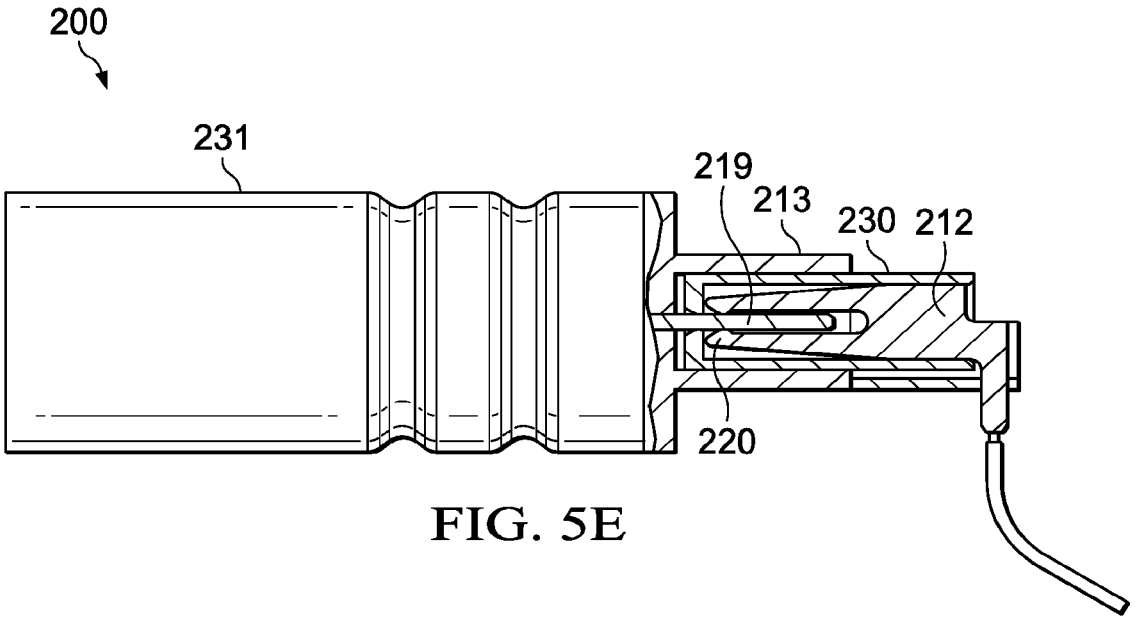
FIG. 5E shows a side cross section of a modular initiator assembly.
Figure 5F:
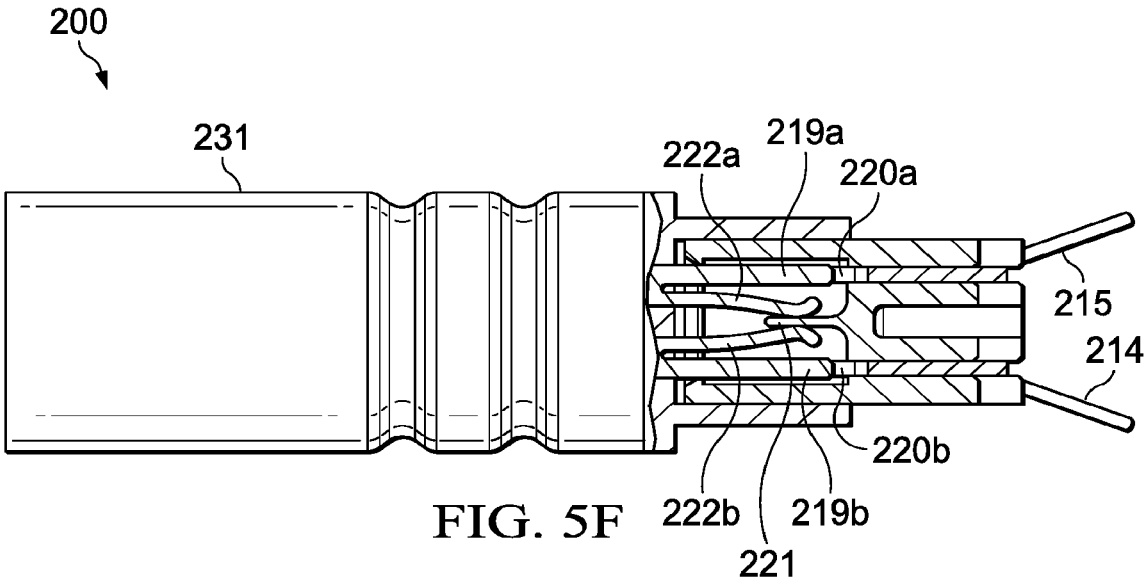
FIG. 5F shows a top cross section of a modular initiator assembly.

Stage 3 is depicted in FIGS. 5E and 5F when the receptacle 212 is more than two thirds of the way inserted into connector 213. The receptacle 212 is in electrical communication with the connector 213 and is no longer shunted. As can be seen in FIG. 5F, the shunt contacts 222*a* and 222*b* are not electrically in contact with each other due to separator 221 wedging them apart, therefore contact blades 219*a* and 219*b* are unshunted, and thus wires 214 and 215 are no longer in contact with each other. The signal contacts 220*a* and 220*b* are engaged with the corresponding blades 219*a* and 219*b*.

Figure 6B:
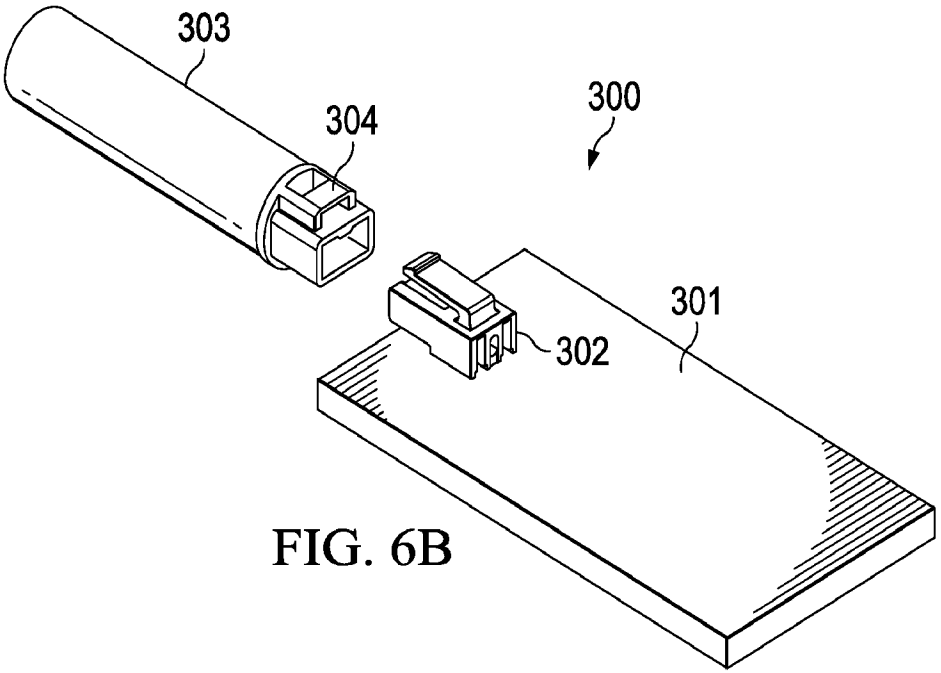
FIG. 6B shows a modular initiator assembly hard mounted to a circuit board.
Figure 6A:
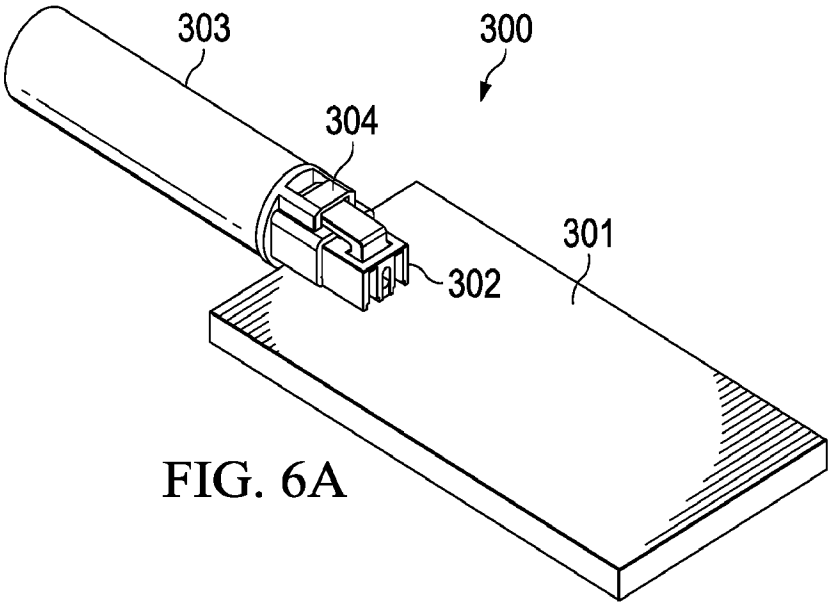
FIG. 6A shows a modular initiator assembly hard mounted to a circuit board.

Different configurations of a modular initiator assembly 300 are shown in FIGS. 6A-6F. In FIGS. 6A and 6B the receptacle 302 is shown hard mounted to a circuit board 301. The receptacle 302 connects to connector 304. Connector 304 is coupled to an initiator 303. FIG. 6A shows the receptacle 302 coupled to the connector 304 and FIG. 6B shows the receptacle 302 uncoupled from the connector 304.

Figure 6D:
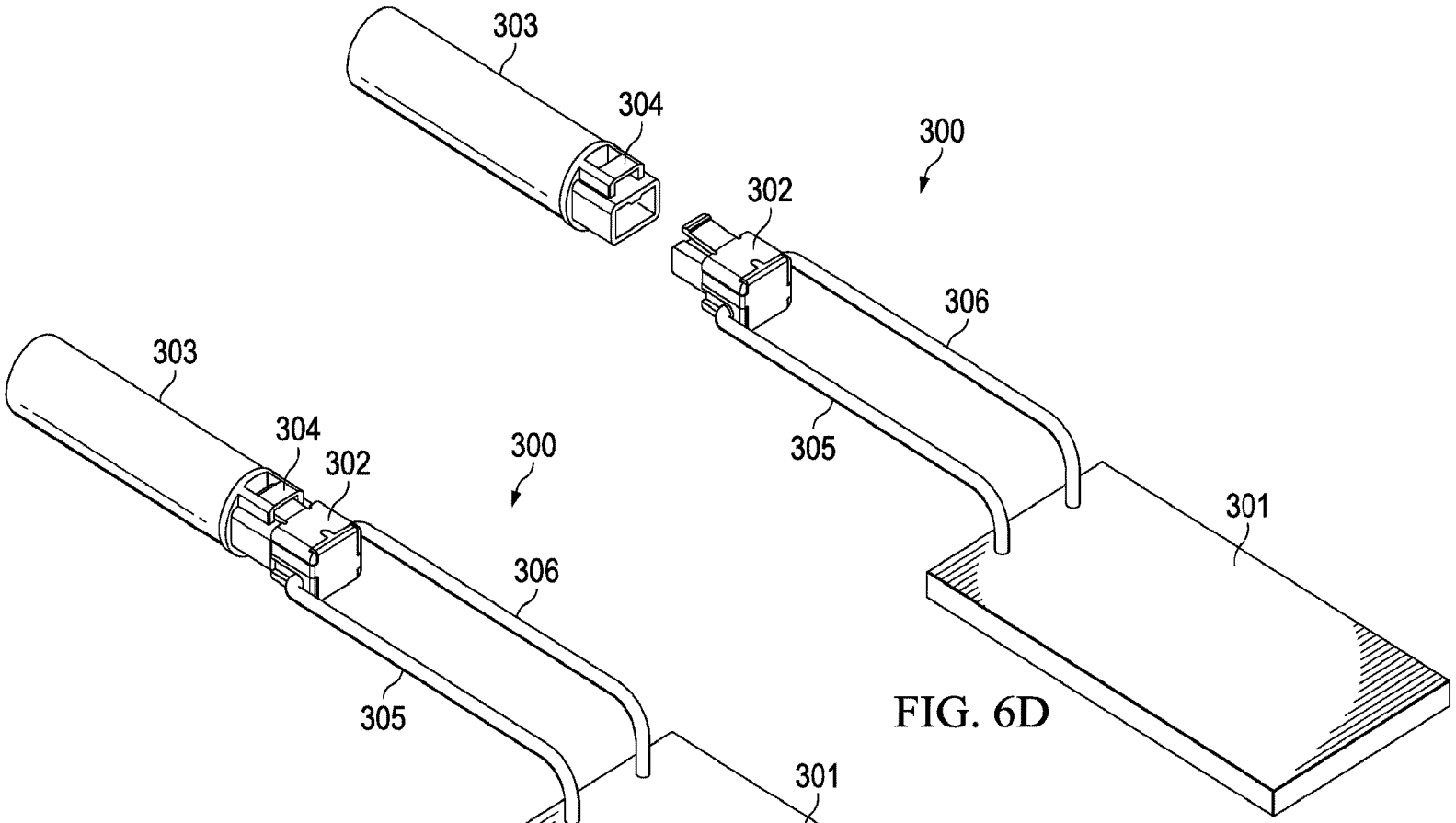
FIG. 6D shows a modular initiator assembly wired to a circuit board.
Figure 6C:
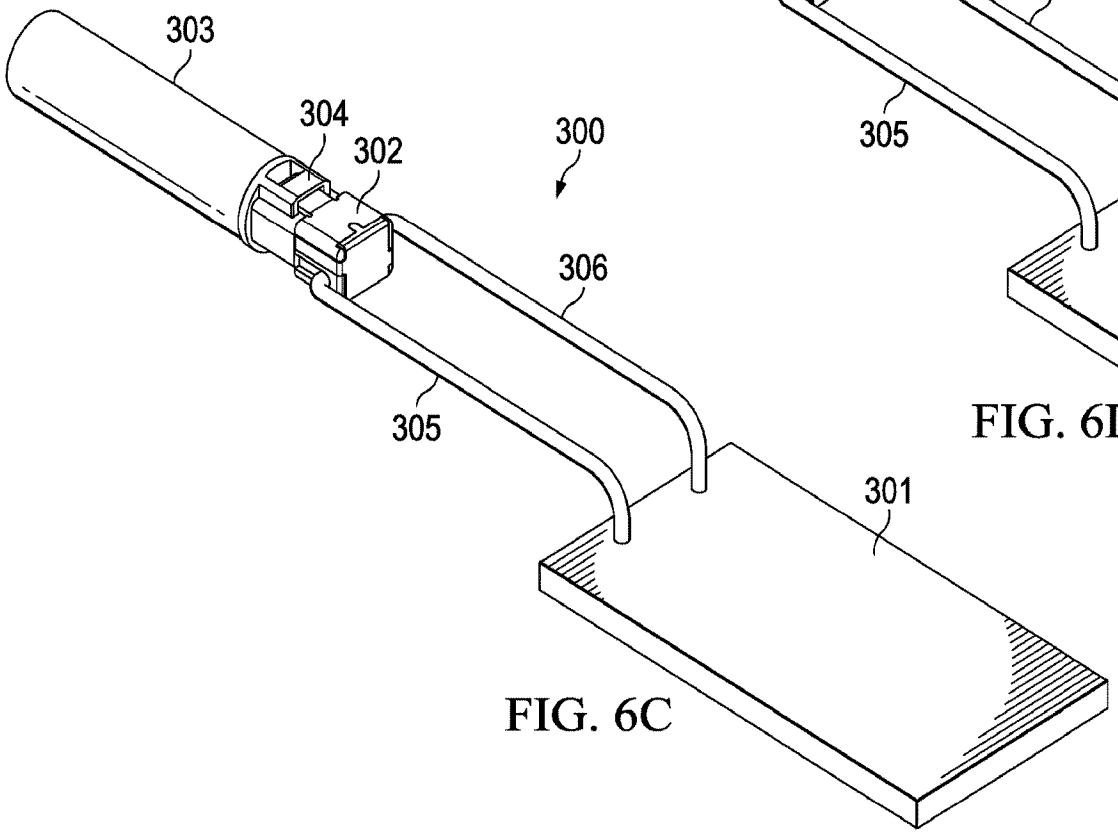
FIG. 6C shows a modular initiator assembly wired to a circuit board.

In FIGS. 6C and 6D the receptacle 302 is shown attached to a circuit board 301 via wire leads 305 and 306. The receptacle 302 connects to connector 304. Connector 304 is coupled to an initiator 303. FIG. 6C shows the receptacle 302 coupled to the connector 304 and FIG. 6D shows the receptacle 302 uncoupled from the connector 304.

Figure 6F:
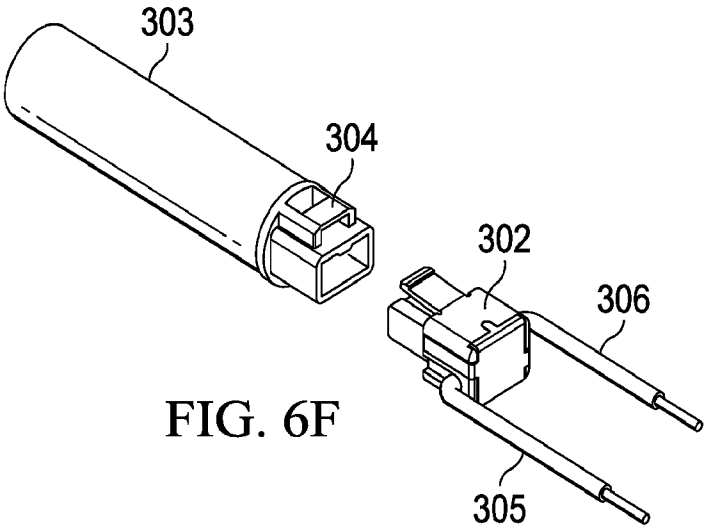
FIG. 6F shows a modular initiator assembly.
Figure 6E:
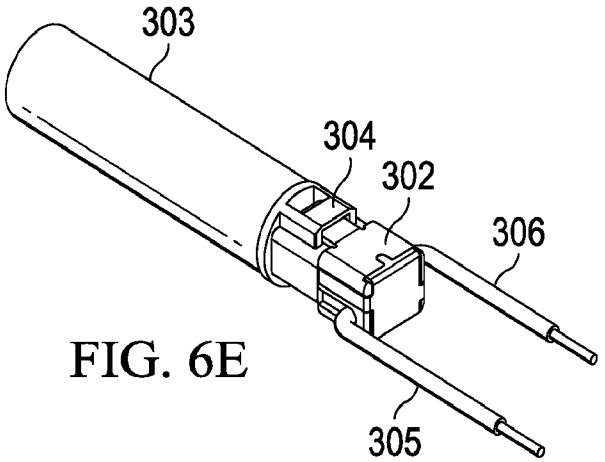
FIG. 6E shows a modular initiator assembly.

In FIGS. 6E and 6F the receptacle 302 is shown with wire leads only. The receptacle 302 connects to connector 304. Connector 304 is coupled to an initiator 303. FIG. 6E shows the receptacle 302 coupled to the connector 304 and FIG. 6F shows the receptacle 302 uncoupled from the connector 304.

Figure 7A:
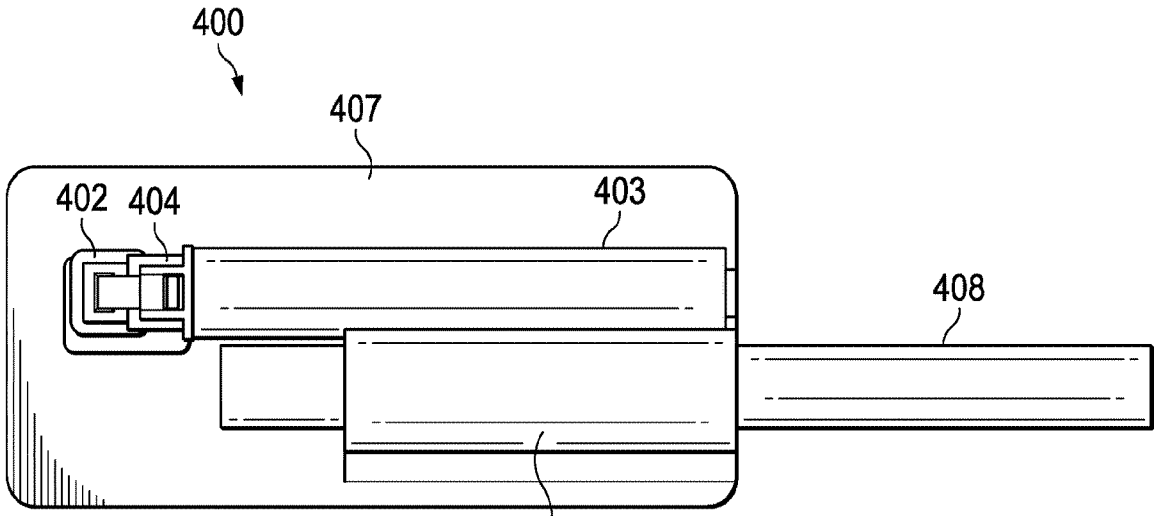
FIG. 7A shows a top view of a modular initiator assembly.
Figure 7B:
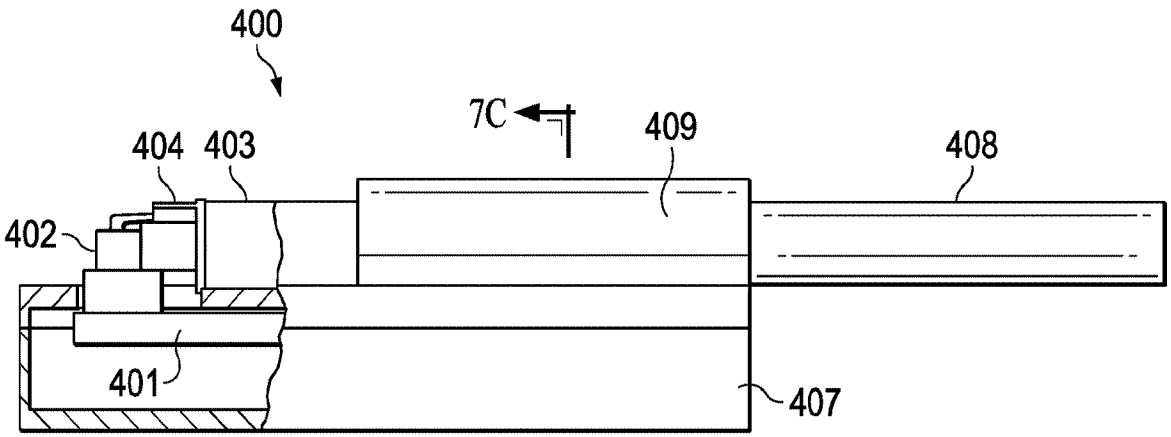
FIG. 7B shows a side view of modular initiator assembly.
Figure 7C:
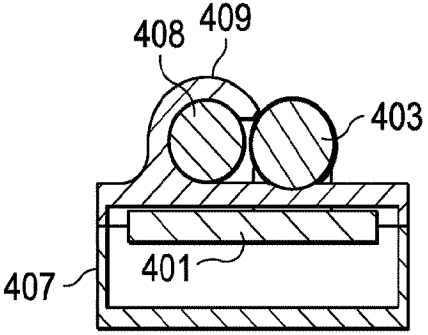
FIG. 7C shows a cross-sectioned view of a modular initiator assembly.

An example embodiment is shown in FIGS. 7A, 7B, and 7C where a modular initiator assembly 400 includes a circuit board 401 within a housing 407. A receptacle 402 is hard mounted to the circuit board and protrudes from the housing 407. The receptacle 402 is coupled to connector 404. Connector 404 is coupled to initiator 403. The distal end of a detonating cord 408 is held in placed by retainer 409 side-by-side to the initiator 403. The detonating cord 408 may have a booster attached the distal end.

Figure 8A:
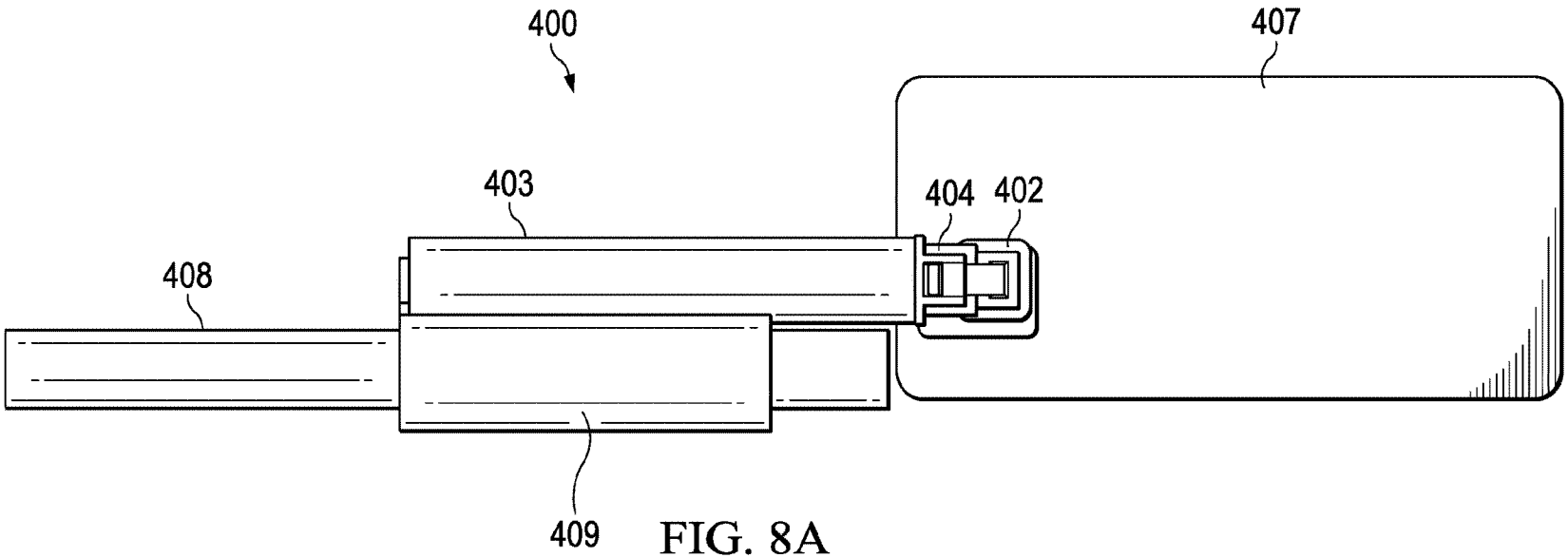
FIG. 8A shows a top view of a modular initiator assembly.
Figure 8B:
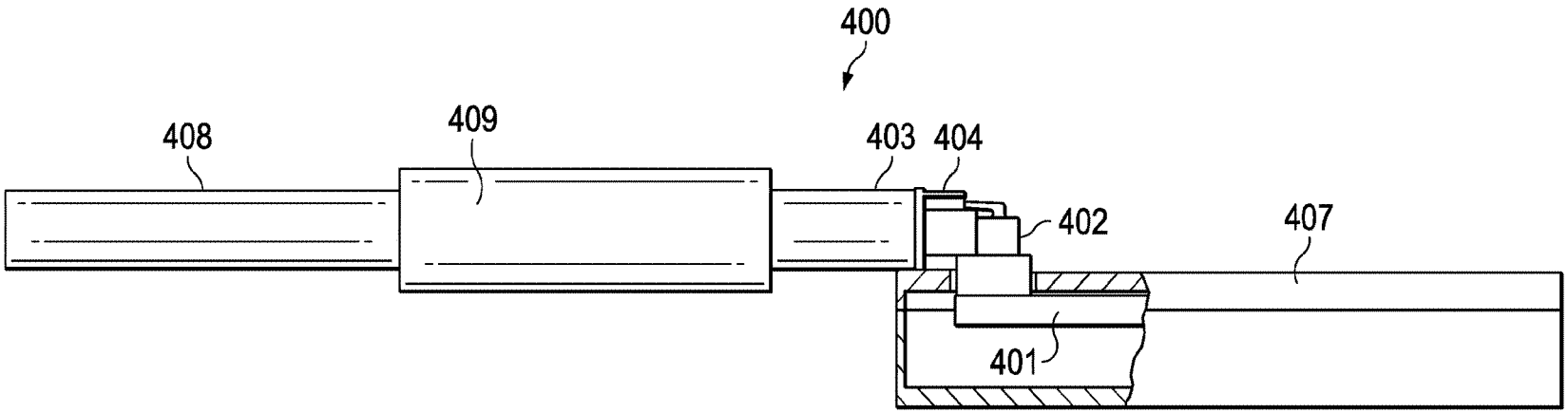
FIG. 8B shows a side view of modular initiator assembly.

An example embodiment is shown in FIGS. 8A and 8B in a different configuration from FIGS. 7A, 7B, and 7C. The modular initiator assembly 400 includes a circuit board 401 within a housing 407. A receptacle 402 is hard mounted to the circuit board and protrudes from the housing 407. The receptacle 402 is coupled to connector 404. Connector 404 is coupled to initiator 403. The distal end of a detonating cord 408 is held in placed by retainer 409 side-by-side to the initiator 403. The detonating cord 408 may have a booster attached to the distal end.

Figure 9:
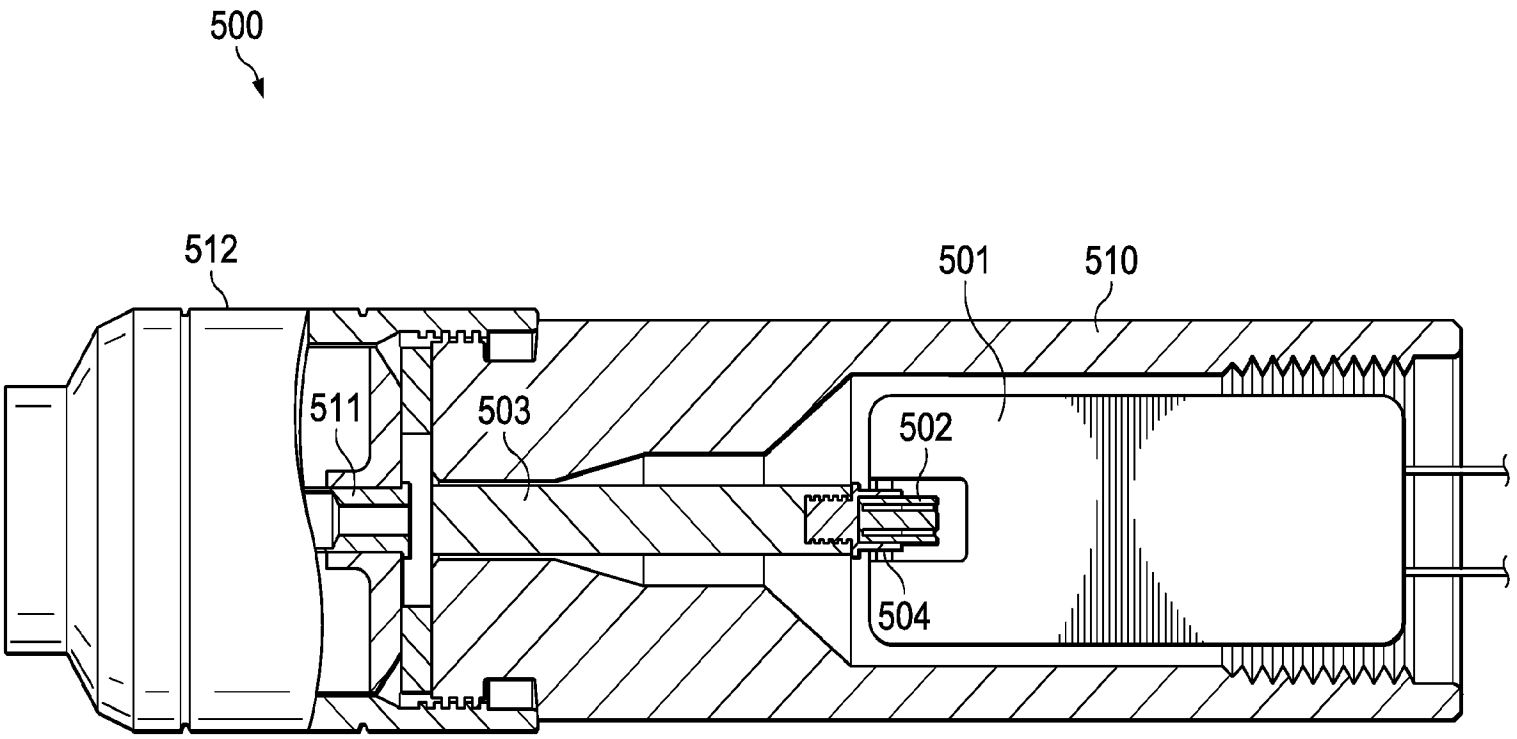
FIG. 9 shows a cross sectioned view of a jet cutter.

An example embodiment is shown in FIG. 9 shows a jet cutter assembly 500 having a jet cutter top sub 510 coupled to a jet cutter housing 512. Within jet cutter housing 512 is an initiator 503 located proximate to the jet cutter booster 511 for the jet cutter charge. The initiator 503 is coupled to the connector 504. Connector 504 is coupled to the receptacle 502. Receptacle 502 is hard mounted onto the circuit board housing 501.

Figure 10A:
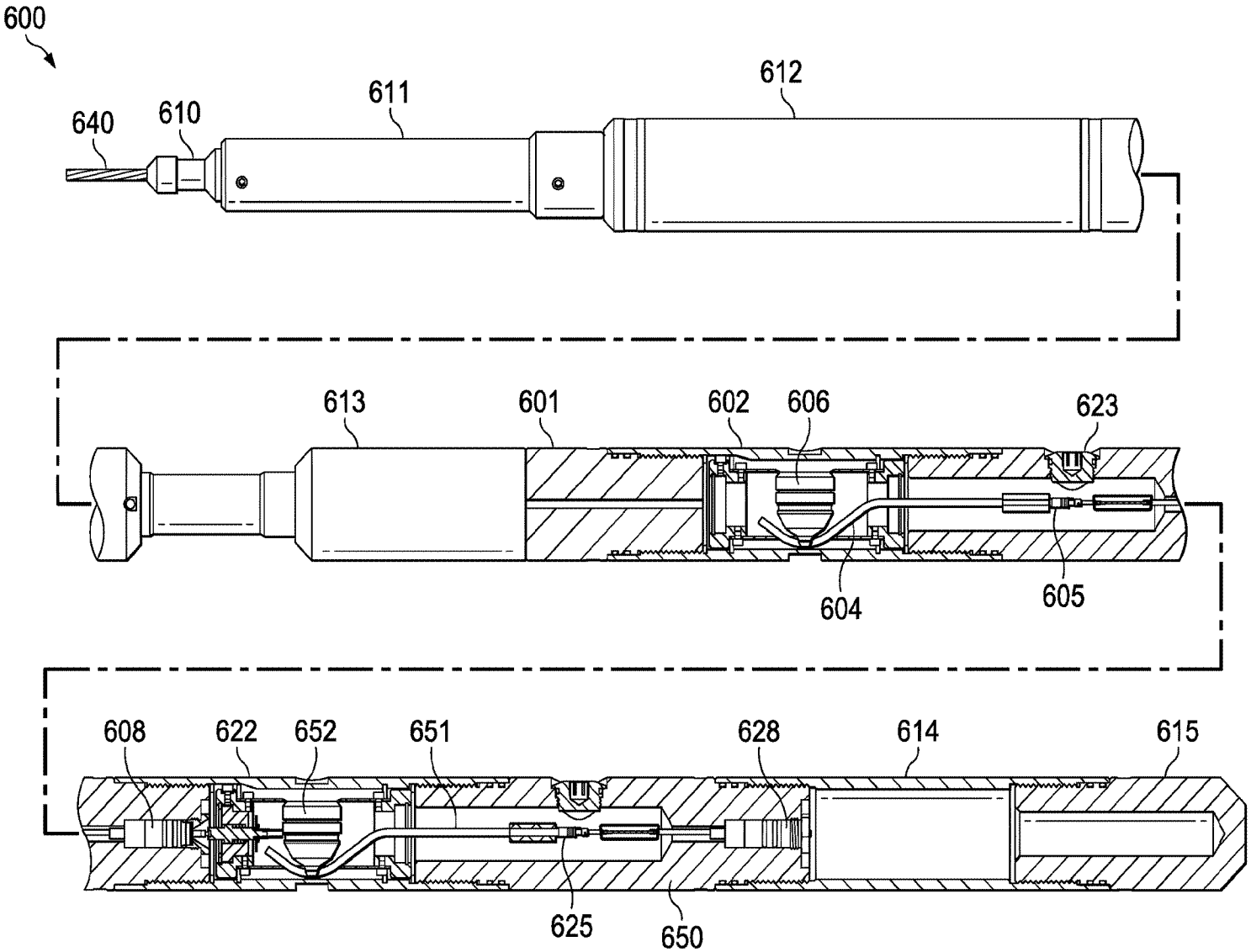
FIG. 10*a* shows a cross sectioned view of a gun string assembly.

An example embodiment is shown in FIG. 10*a* of a perforating gun string assembly 600. The gun string assembly 600 is suspended by a wireline 640 coupled to a cablehead assembly 610. A fishing neck assembly 611 is coupled to and located downhole from the cablehead assembly 610. A casing collar locator 612 is coupled to and located downhole from the fishing neck assembly 611. A quick change assembly 613 is coupled to and located downhole from the casing collar locator 612. A top sub 601 is coupled to and located downhole from the quick change assembly 613. A first gun assembly 602 is coupled to and located downhole from the top sub 601.

The first gun assembly 602 contains a shaped charge 606 coupled to a detonating cord 604. The detonating cord 604 is coupled to a modular initiator assembly 605 located within a switch tandem 623. The switch tandem 623 is coupled to and located downhole from the first gun assembly 602. The modular initiator assembly 605 is coupled to a bulkhead feedthrough 608, which is further coupled to a feed thru puck assembly 609 that is held in place with a snap ring 607. A second gun assembly 622 is coupled to and located downhole from the switch tandem 623. A second switch tandem 650 is coupled to and located downhole from the second gun assembly 622. Within the second switch tandem 650 is a modular initiator 625 that is further coupled to a bulkhead feedthrough 628. A blast sleeve 614 is coupled to and located downhole from the second switch tandem 650. A gun bottom 615 is coupled to and located downhole from the blast sleeve 614.

Figure 10B:
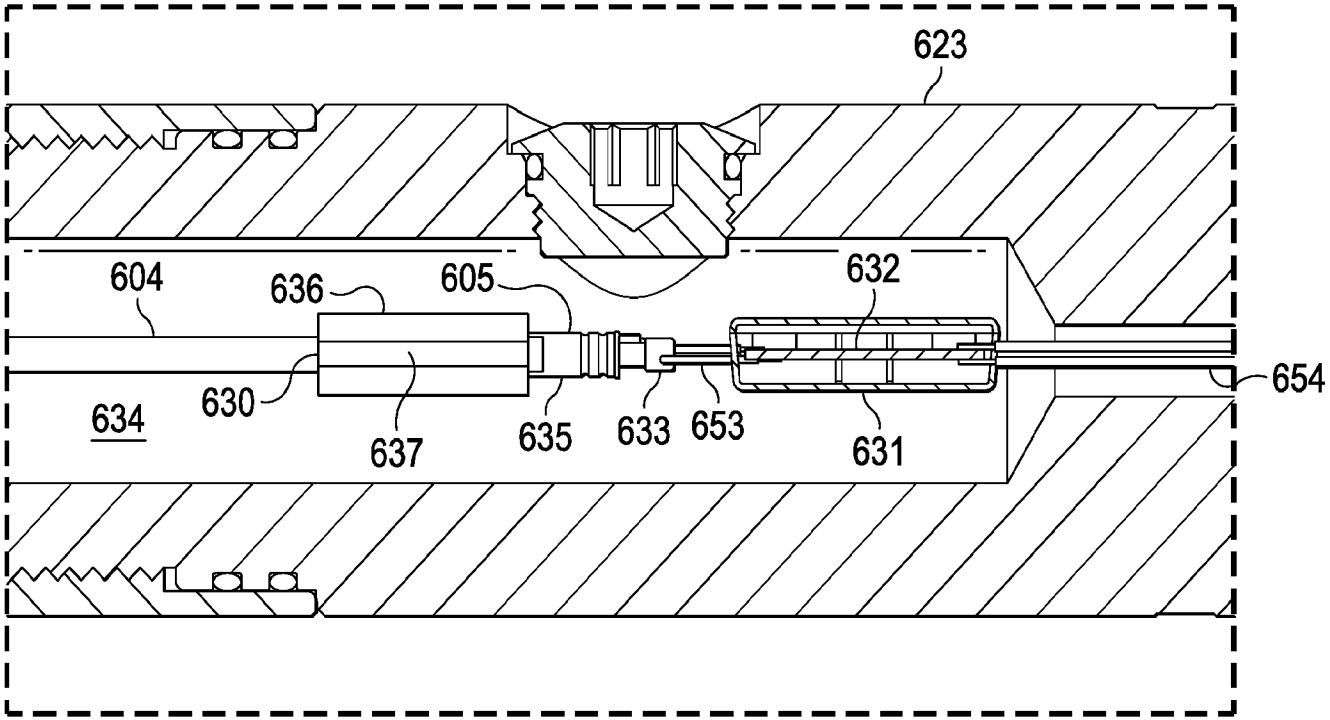
FIG. 10*b* shows a close-up view of a cross sectioned view of a tandem sub with a modular initiator assembly.

A close up cross section of switch tandem 623 is shown in FIG. 10*b*. A modular initiator assembly 605 is located within bore 634. A housing 631 containing a circuit board 632 is electrically coupled via a plurality of conductors to receptacle 633. Receptacle 633 has been mated to connector 635. Connector 635 has an initiator 637 coupled to it within a block 636. A distal end 630 of detonating cord 604 is coupled to and a portion is located side-by-side the initiator 637.

Figure 11A:
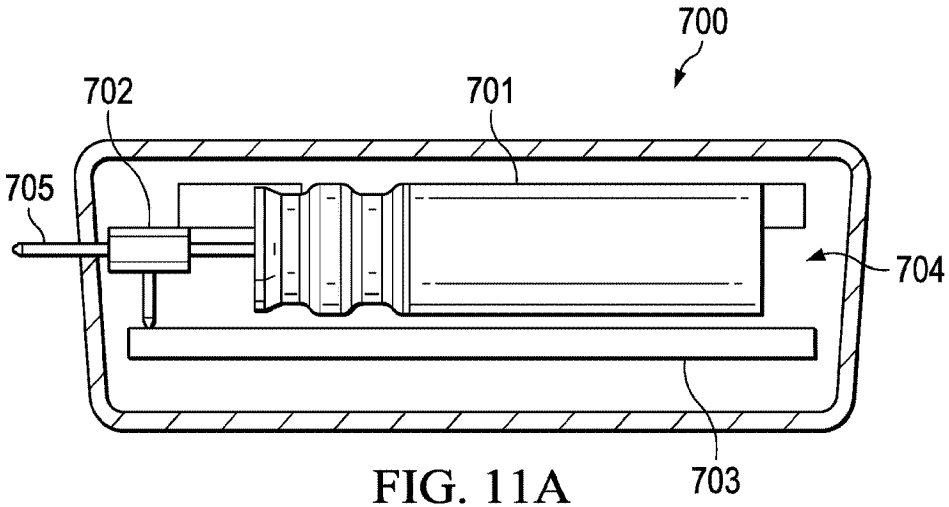
FIG. 11A shows an initiator with a t-shaped connector.
Figure 11B:
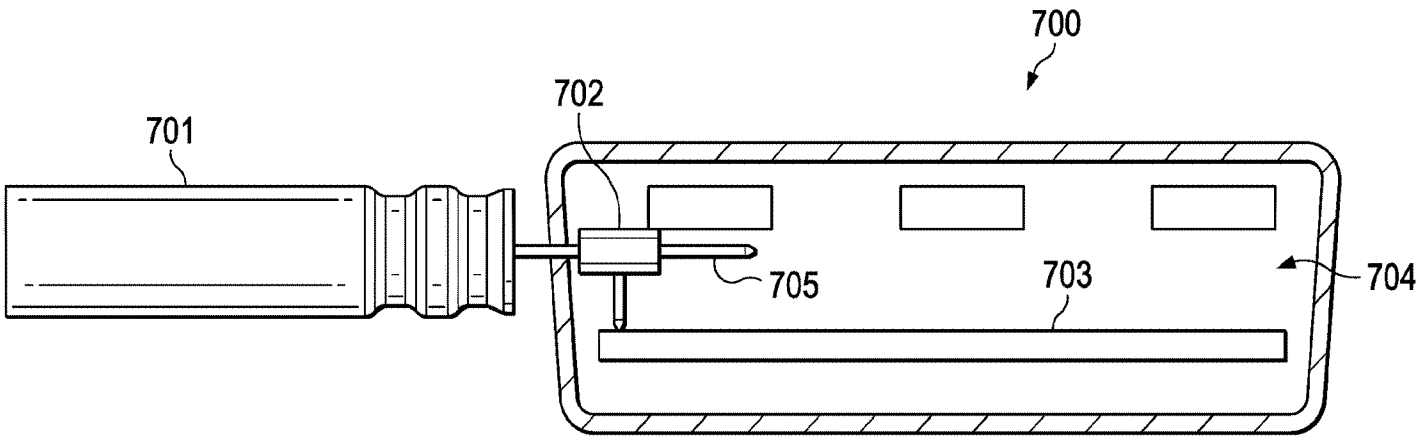
FIG. 11B shows an initiator with a t-shaped connector.

An example embodiment of a t-shaped connector for a modular initiator 700 is shown in FIGS. 11A and 11B. A control fire board 703 within a housing 704 includes a t-shaped pin 702 connected to an initiator 701. The pin 705 provides shunting and is removable.

Figure 12A:
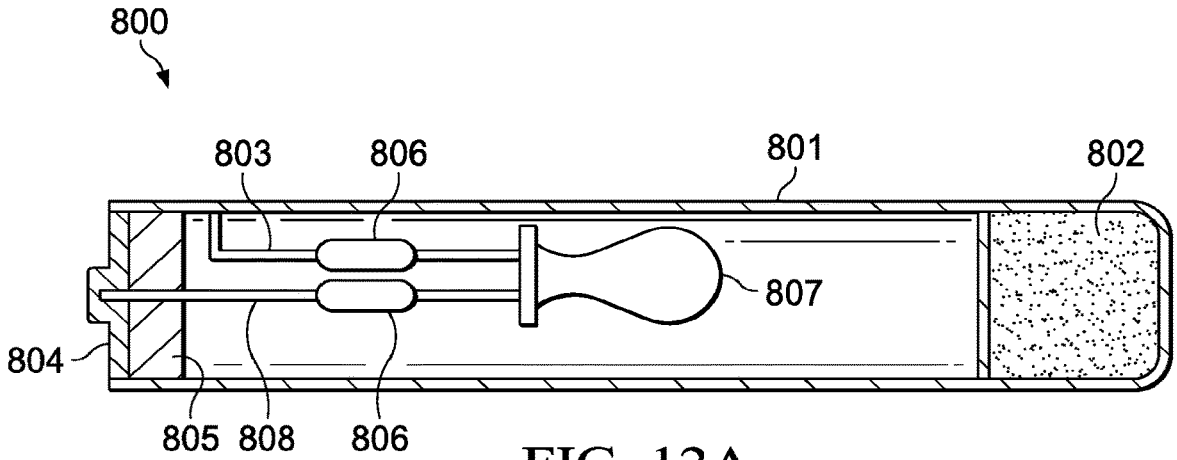
FIG. 12A shows a battery style initiator cross-section.
Figure 12B:
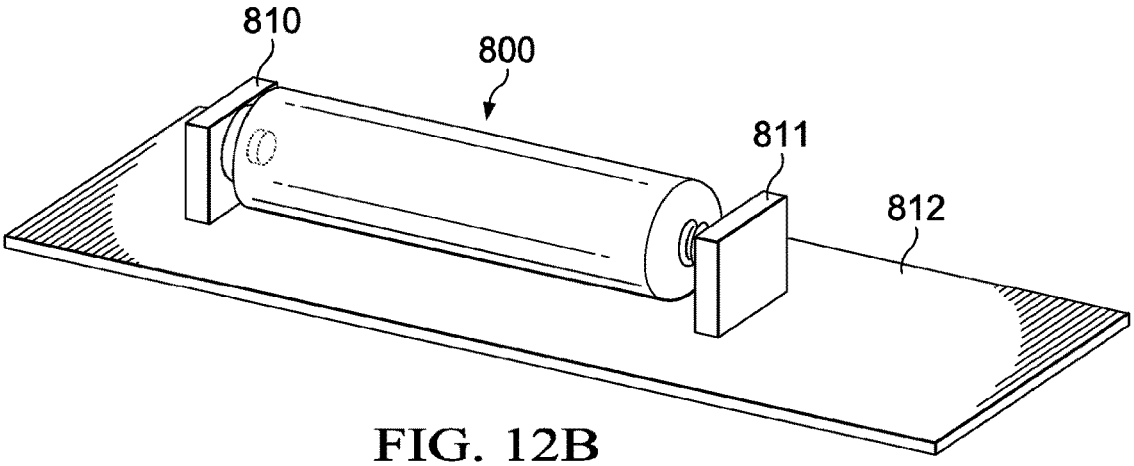
FIG. 12B shows a battery style initiator coupled to a circuit board.
Figure 12C:
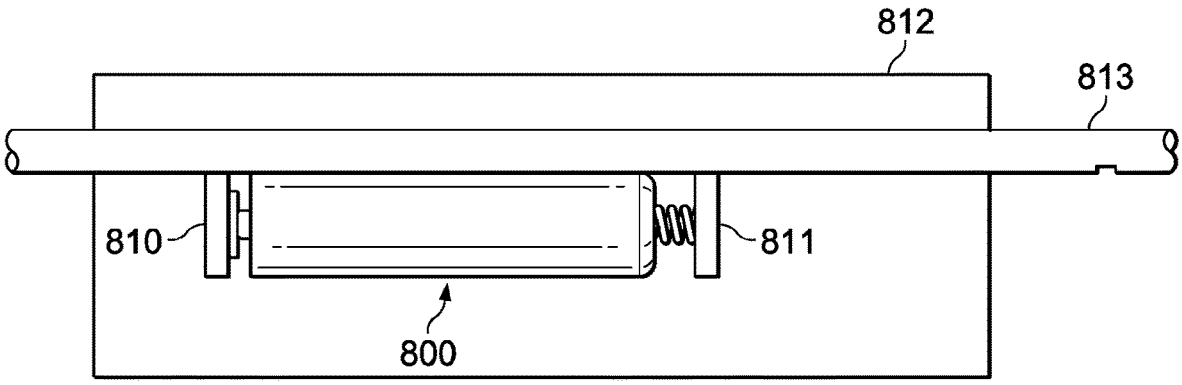
FIG. 12C shows a battery style initiator coupled to a circuit board.
Figure 12D:
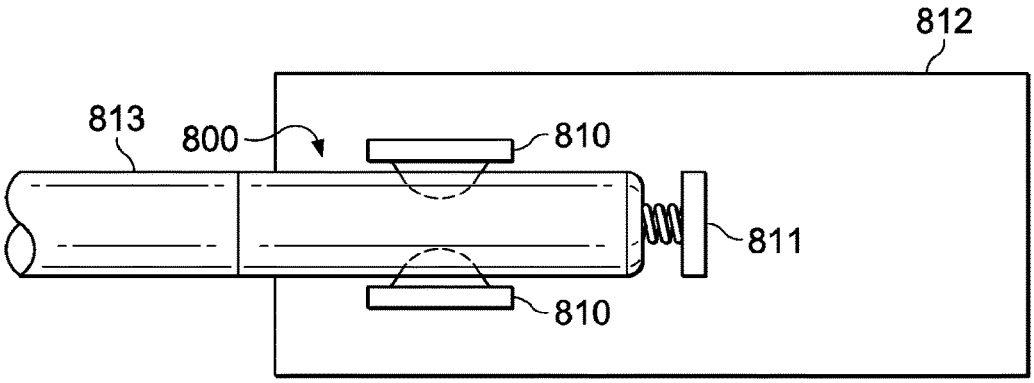
FIG. 12D shows a battery style initiator coupled to a circuit board.

An example embodiment of a battery style modular initiator 800 is shown in FIGS. 12A, 12B, 12C, and 12D. An initiator 801 includes an explosive 802, a wire 807 for initiating the explosive 802, a first lead 808 that goes to a center point electrical contact 804, an insulator 805, a second lead 803 that contacts the electrically conductive exterior of initiator 801. In FIG. 12B the battery style modular initiator 800 is shown connected to a circuit board 812 with terminals 810 and 811. In FIG. 12C the battery style modular initiator 800 is located side-by-side detonating cord 813. In FIG. 12D the battery style modular initiator 800 has one set of contacts terminals 810 on the side of the initiator while the end contact terminal 811 is connected to the center point electrical contact.

Figure 13A:
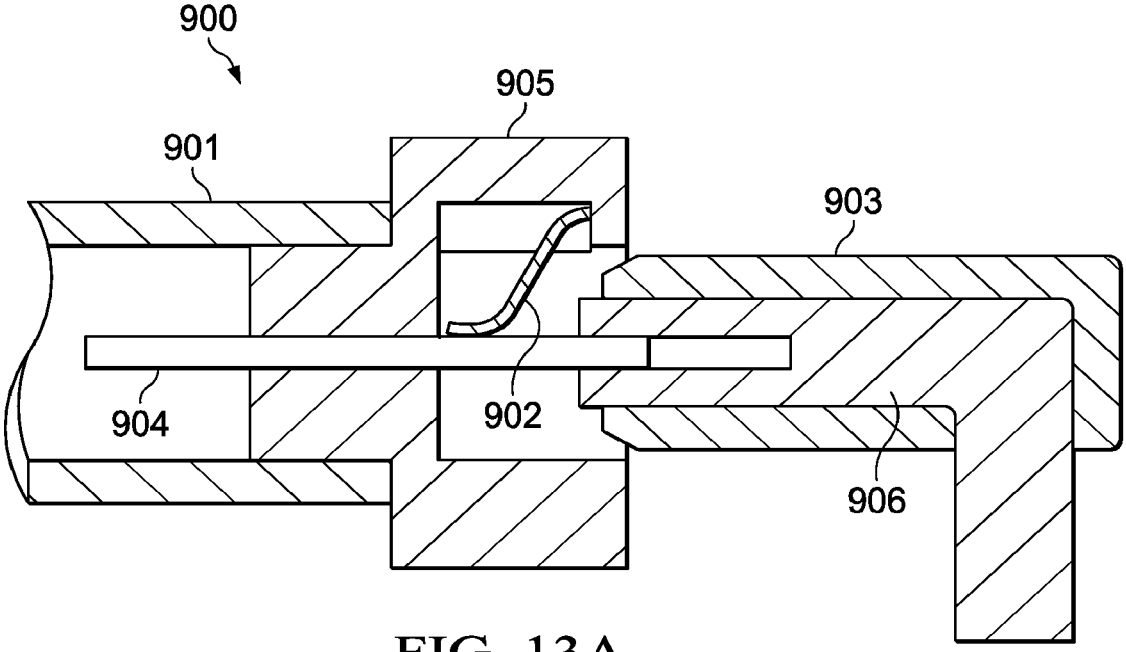
FIG. 13A shows a cross section of a partially inserted shunt and initiator connection.
Figure 13B:
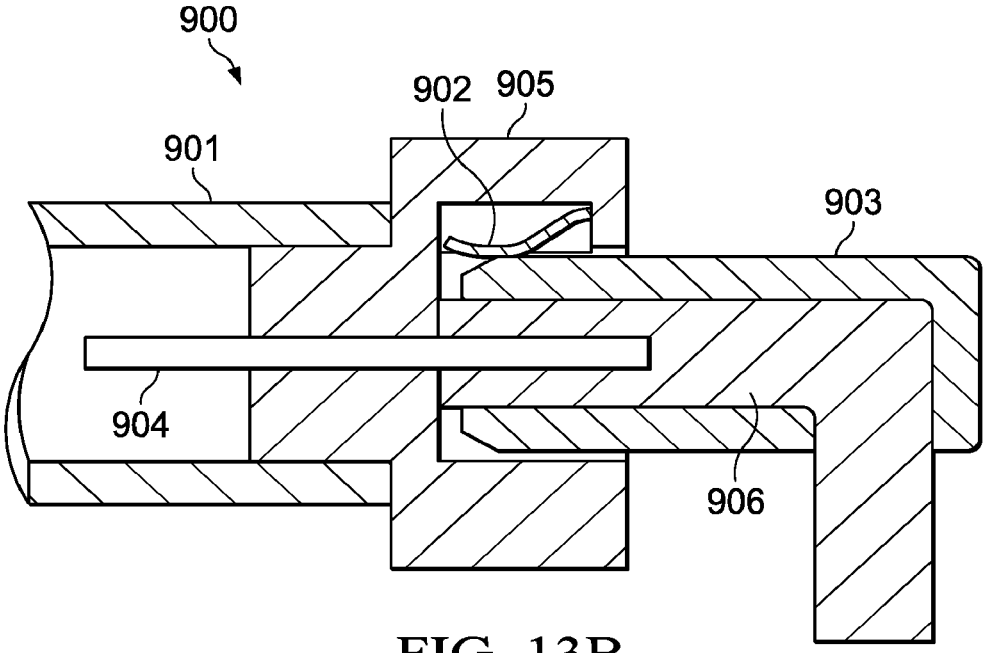
FIG. 13B shows a cross section of a fully inserted shunt and initiator connection.

An example embodiment of a shunting initiator connection 900 with contact circuit is shown in FIGS. 13A and 13B. It has a detonator shell 901, a short/shunt tab 902, a shunt lift mechanism 903, an electrical contact pin 904, a connector housing 905, and an electrical contact circuit 906. There may be a plurality of pins 904 that are shunted by a single short/shunt tab 902. FIG. 13A shows an example where the shunting initiator connection 900 is partially inserted and FIG. 13B shows an example where the shunting initiator connection 900 is fully inserted.

Figure 14:
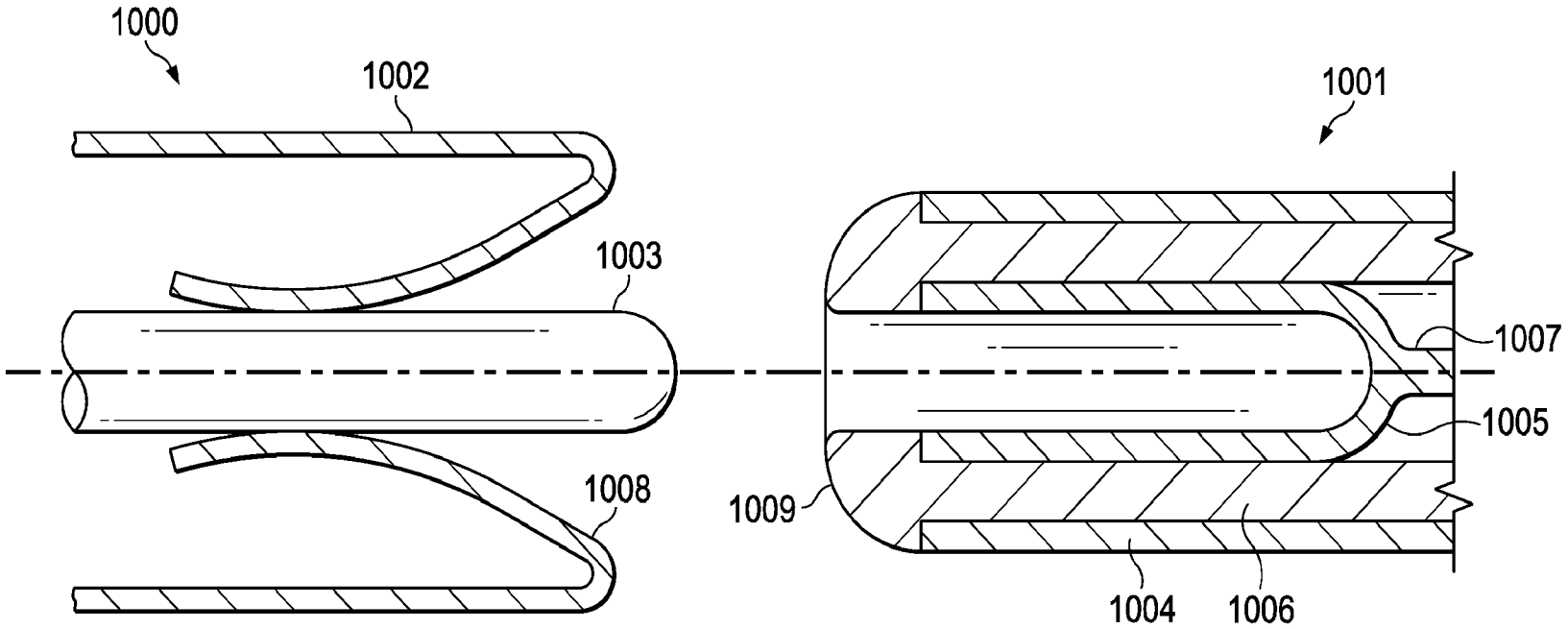
FIG. 14 shows a cross section view of a self-shunting coaxial male and female connector.

An example embodiment of a self-shunting coaxial connector is shown in FIG. 14. A coaxial male connector 1000 has an electrically conductive line 1003, it may be coupled to a positive wire, and an outer electrically conductive spring contact 1002, that may be coupled to a negative wire. The spring contact 1002 is by default in contact with line 1003 due to a springing action, which provides a self-shunting feature for the male connector 1000. The female connector 1001 has an outer electrically conductive radial portion 1004, a radial insulator 1006, and an inner receptacle 1005 that is electrically conductive. Inner receptacle 1005 is coupled to a line 1007. When the male connector 1000 is initially inserted into the female connector 1000, the spring contact 1002 makes electrical contact with the radial portion 1004 and the line 1003 makes electrical contact with the receptacle 1005. The curvature 1008 of the spring contact 1002 interfacing with the curvature 1009 of the female connector forces the spring contact 1002 away from the line 1003 as the male connector 1000 is fully inserted into the female connector 1001, thus removing the shunt after first establishing electrical contact.

The application for the example embodiments may be used with different types of initiators including resistor based bridgewire initiators, exploding bridge wire initiators, exploding foil initiators, and any other style of electric or electronic initiator. The modular initiator in the example embodiment is a packaged unit, which may include resistors, capacitors, or other electrical components. It may include a circuit board or other electronic circuitry. The modular initiator may be assembled or incorporated into an electrical circuit as a new assembly. The modular initiator may function as a standalone unit. A contact assembly without electronic circuitry may be employed which would receive the initiator and pass through electrical signals to the initiator.

The modular initiator includes a shell containing a high explosive such as lead azide, RDX, HMX, HNS, a bridge element or foil initiator, and electrical components such as resistors, capacitors, spark gaps, electronic circuits, etc. The modular initiator may contain a rigid connector. The rigid connector may be incorporated in many configurations. The rigid connector may be a male pin-style or female style socket. The connector may incorporate a shunting mechanism. The purpose of the shunting mechanism is to act as a protective barrier against radio frequency (RF) energy and stray electrical energy by electrically shorting the contacts. The short length and removal of leg wires also creates RF resistance. The modular initiator must be protected from RF when transported off-site on public roads. The modular initiator could be installed to an electronic circuit with its own RF protection during the installation process. For situations where the shunt must be removed, a safety housing can be employed to protect personnel if the modular initiator were to initiate during installation. Robotics installation methods could also be used when shunting is not available.

Auto-Shunting Electrical Connection or Auto-Shorting Electrical Connection (ASEC)—An ASEC is an electrical connection comprising at least one connector with a self-contained feature which electrically shorts two or more electrical contact paths of the connector when the connector is disconnected from, in the process of being disconnected from, or is being connected to a mating connector which includes at least one design feature which disengages the shorting feature of the first connector after electrical contact is established or allows the shorting feature of the first connector to reengage before electrical contact is broken.

Auto-Shunting Electric Initiator or Auto-Shorting Electric Detonator (ASED)—An ASED is an electric or electronic initiator of any variety in which electrical energy is converted to an high energy output wherein the electric or electronic initiator includes the attached connector of an ASEC with the self-contained feature to electrically short two or more electrical contact paths and the electrical contact paths of the ASEC connector include the electrical contact paths of the electric or electronic initiator and at least part of the path through which electrical energy is converted to a high energy output.

Initiators may be used to initiate a perforating gun, a cutter, a setting tool, or other downhole energetic device. For example, a cutter is used to cut tubulars with focused energy. A setting tool uses a pyrotechnic to develop gases to perform work in downhole tools. Any downhole device that uses an initiator may be adapted to use the modular initiator assembly disclosed herein.

Although the invention has been described in terms of embodiments which are set forth in detail, it should be understood that this is by illustration only and that the invention is not necessarily limited thereto. For example, terms such as upper and lower or top and bottom can be substituted with uphole and downhole, respectfully. Top and bottom could be left and right, respectively. Uphole and downhole could be shown in figures as left and right, respectively, or top and bottom, respectively. Generally downhole tools initially enter the borehole in a vertical orientation, but since some boreholes end up horizontal, the orientation of the tool may change. In that case downhole, lower, or bottom is generally a component in the tool string that enters the borehole before a component referred to as uphole, upper, or top, relatively speaking. The first housing and second housing may be top housing and bottom housing, respectfully. In a gun string such as described herein, the first gun may be the uphole gun or the downhole gun, same for the second gun, and the uphole or downhole references can be swapped as they are merely used to describe the location relationship of the various components. Terms like wellbore, borehole, well, bore, oil well, and other alternatives may be used synonymously. Terms like tool string, tool, perforating gun string, gun string, or downhole tools, and other alternatives may be used synonymously. The alternative embodiments and operating techniques will become apparent to those of ordinary skill in the art in view of the present disclosure. Accordingly, modifications of the invention are contemplated which may be made without departing from the spirit of the claimed invention.

What is claimed is:

1. A modular initiator connection comprising:

a connector attached to an initiator;

a first contact blade within the connector and electrically connected to a first resistor contact;

a second contact blade within the connector and electrically connected to a second resistor contact;

a first conductive shunt contact integral to the first contact blade within the connector forming an electrical shunt between the first contact blade and the second contact blade and having a curved surface facing away from the connector;

a receptacle;

a first signal contact within the receptacle and adapted to electrically connect to the first contact blade;

a second signal contact within the receptacle and adapted to electrically connect to the second contact blade;

a nonconductive separator within the receptacle between the first signal contact and the second signal contact adapted to mechanically and electrically separate the first shunt contact and the second blade contact when the receptacle is fully inserted into the connector by wedging the curved surface of the first conductive shunt away from the second contact blade;

a latch adapted to lock the receptacle into the connector;

wherein inserting the receptacle into the connector first electrically connects the first contact blade and second contact blade to the first signal contact and second signal contact respectively, second electrically separate the first shunt contact and the second blade contact with the nonconductive separator, and third engages the latch to lock the receptacle into the connector; and wherein the first resistor contact and second resistor contact provide electrical connection to the initiator.

2. A modular initiator connection comprising:

a connector attached to an initiator;

a first contact blade within the connector;

a second contact blade within the connector;

a first conductive shunt contact within the connector forming an electrical shunt between the first contact blade and the second contact blade;

a receptacle;

a first signal contact within the receptacle and adapted to electrically connect to the first contact blade;

a second signal contact within the receptacle and adapted to electrically connect to the second contact blade;

a nonconductive separator within the receptacle adapted to mechanically and electrically separate the first shunt contact and the second blade contact as the receptacle is inserted into the connector;

wherein the first resistor contact and second resistor contact provide electrical connection to the initiator.

3. The modular initiator connection of claim 2, wherein:

the first contact blade is electrically connected to a first resistor contact; and the second contact blade is electrically connected to a second resistor contact; and wherein the first resistor contact and second resistor contact provide electrical connection to the initiator.

4. The modular initiator connection of claim 2, wherein:

the first conductive shunt contact is integral to the first contact blade.

5. The modular initiator connection of claim 2, wherein:

the nonconductive separator wedges the first conductive shunt away from the second contact blade as the receptacle is fully inserted into the connector.

6. The modular initiator connection of claim 2, wherein:

the first conductive shunt contact has a curved surface facing away from the connector.

7. The modular initiator connection of claim 6, wherein:

the nonconductive separator wedges the curved surface of the first conductive shunt away from the second contact blade as the receptacle is fully inserted into the connector.

8. The modular initiator connection of claim 2, wherein:

the nonconductive separator is between the first signal contact and the second signal contact.

9. The modular initiator connection of claim 2 further comprising:

a latch adapted to lock the receptacle into the connector.

10. The modular initiator connection of claim 9 further comprising:

wherein inserting the receptacle into the connector first electrically connects the first contact blade and second contact blade to the first signal contact and second signal contact respectively, second electrically separate the first shunt contact and the second blade contact with the nonconductive separator, and third engages the latch to lock the receptacle into the connector.

11. A perforating gun assembly comprising:

a shaped charge a detonating cord coupled to the shaped charge;

a modular initiator coupled to the detonating cord;

wherein the modular initiator includes a receptacle coupled to the modular initiator, a connector attached to an initiator, a first contact blade within the connector and electrically connected to a first resistor contact, a second contact blade within the connector and electrically connected to a second resistor contact, a first conductive shunt contact integral to the first contact blade within the connector forming an electrical shunt between the first contact blade and the second contact blade and having a curved surface facing away from the connector;

a receptacle coupled to the modular initiator;

wherein the receptacle includes a first signal contact within the receptacle and adapted to electrically connect to the first contact blade, a second signal contact within the receptacle and adapted to electrically connect to the second contact blade, a nonconductive separator within the receptacle between the first signal contact and the second signal contact adapted to mechanically and electrically separate the first shunt contact and the second blade contact when the receptacle is fully inserted into the connector by wedging the curved surface of the first conductive shunt away from the second contact blade;

a latch adapted to lock the receptacle into the connector;

wherein inserting the receptacle into the connector first electrically connects the first contact blade and second contact blade to the first signal contact and second signal contact respectively, second electrically separate the first shunt contact and the second blade contact with the nonconductive separator, and third engages the latch to lock the receptacle into the connector; and wherein the first resistor contact and second resistor contact provide electrical connection to the initiator.

12. A perforating gun assembly comprising:

a shaped charge a detonating cord coupled to the shaped charge;

a modular initiator coupled to the detonating cord;

a receptacle coupled to the modular initiator;

wherein the modular initiator includes a connector attached to an initiator, a first contact blade within the connector, a second contact blade within the connector, and a first conductive shunt contact within the connector forming an electrical shunt between the first contact blade and the second contact blade;

wherein the modular initiator includes a first signal contact within the receptacle and adapted to electrically connect to the first contact blade, a second signal contact within the receptacle and adapted to electrically connect to the second contact blade, a nonconductive separator within the receptacle adapted to mechanically and electrically separate the first shunt contact and the second blade contact as the receptacle is inserted into the connector.

13. The perforating gun assembly of claim 12, wherein:

the first contact blade is electrically connected to a first resistor contact; and the second contact blade is electrically connected to a second resistor contact; and wherein the first resistor contact and second resistor contact provide electrical connection to the initiator.

14. The perforating gun assembly of claim 12, wherein: the first conductive shunt contact is integral to the first contact blade.

15. The perforating gun assembly of claim 12, wherein: the nonconductive separator wedges the first conductive shunt away from the second contact blade as the receptacle is fully inserted into the connector.

16. The perforating gun assembly of claim 12, wherein: the first conductive shunt contact has a curved surface facing away from the connector.

17. The perforating gun assembly of claim 12, wherein: the nonconductive separator wedges the curved surface of the first conductive shunt away from the second contact blade as the receptacle is fully inserted into the connector.

18. The perforating gun assembly of claim 12, wherein:

the nonconductive separator is between the first signal contact and the second signal contact.

19. The perforating gun assembly of claim 12 further comprising:

a latch adapted to lock the receptacle into the connector.

20. The perforating gun assembly of claim 19 further comprising:

wherein inserting the receptacle into the connector first electrically connects the first contact blade and second contact blade to the first signal contact and second signal contact respectively, second electrically separate the first shunt contact and the second blade contact with the nonconductive separator, and third engages the latch to lock the receptacle into the connector.

* * * * *